US005392700A

United States Patent [19]

Kleinhen

[11] Patent Number: 5,392,700

[45] Date of Patent: Feb. 28, 1995

[54] APPARATUS FOR USE IN HANDLING SIGNATURES

[75] Inventor: Stephen R. Kleinhen, Eaton, Ohio

[73] Assignee: AM International, Inc., Chicago, Ill.

[21] Appl. No.: 66,901

[22] Filed: May 24, 1993

Related U.S. Application Data

[63] Continuation-in-part of Ser. No. 34,360, Mar. 19, 1993, Pat. No. 5,312,223.

[51] Int. Cl.[6] ..... B65B 13/00

[52] U.S. Cl. ..... 100/7; 414/789.1; 414/790.3; 414/791.2; 414/794.2; 414/793.6

[58] Field of Search ..... 100/7, 26; 414/788.3, 414/789.1, 790.3, 791.2, 793.5, 793.6, 794.2

[56] References Cited

U.S. PATENT DOCUMENTS

| | | | |
|---|---|---|---|
| 2,964,160 | 12/1960 | Powers . | |
| 3,260,191 | 7/1966 | Pierson et al. | 100/4 |
| 3,269,089 | 8/1966 | Heywood | 414/790.3 X |
| 3,280,725 | 10/1966 | Bartram | 100/4 |
| 3,305,104 | 2/1967 | Hogan et al. | 414/789.9 |
| 3,390,508 | 7/1968 | Heimlicher | 100/7 X |
| 3,532,230 | 10/1970 | Gutberlet et al. | 414/790.3 X |
| 3,599,807 | 8/1971 | Hedrick et al. | 414/790.3 X |
| 4,068,567 | 1/1978 | Allison et al. | 414/788.3 |
| 4,183,704 | 1/1980 | Steinhart | 414/790.3 X |
| 4,457,656 | 7/1984 | Kosina et al. | 414/793.6 X |
| 4,554,867 | 11/1985 | Thumm | 100/7 X |
| 4,611,533 | 9/1986 | Miaskoff et al. | 100/7 |
| 4,720,229 | 1/1988 | Steinhart | 414/790.3 |
| 4,725,180 | 2/1988 | Kasamatsu et al. | 414/790.3 X |
| 4,902,184 | 2/1990 | Fritz | 414/790.3 |
| 5,287,162 | 2/1994 | Prim et al. | 414/790.3 |

FOREIGN PATENT DOCUMENTS

| | | | |
|---|---|---|---|
| 1498021 | 10/1967 | France . | |
| 3816239 | 11/1988 | Germany . | |
| 3736868 | 5/1989 | Germany | 414/790.3 |
| 2165224 | 4/1986 | United Kingdom . | |

OTHER PUBLICATIONS

Publication entitled The JP80 Magazine Strapping Machine, Published by Ovalstrapping Inc., publication date unknown.

*Primary Examiner*—Stephen F. Gerrity
*Attorney, Agent, or Firm*—Tarolli, Sundheim & Covell

[57] ABSTRACT

A stacker assembly receives signatures. A jogger assembly engages signatures supported by the stacker assembly to align edge portions of the signatures. A turntable receives the signatures from the stacker assembly and rotates the signatures to offset relatively thick folded edge portions of the signatures. A conveyor assembly pushes a stack of signatures from the turntable to a tying station in a strapper assembly. The conveyor assembly presses a leading end portion of a stack of signatures against registration surfaces in the strapper assembly to position the main stack of signatures relative to the tying station. A pusher element presses against a trailing end of the stack of signatures to press a leading end of the stack of signatures against the registration surfaces in the strapper assembly and to ensure that the trailing edge portions of the signatures are aligned. The strapper assembly is operable to tie a band around the stack of signatures. The conveyor assembly is then operated to push the bound stack of signatures away from the strapper assembly.

61 Claims, 6 Drawing Sheets

APPARATUS FOR USE IN HANDLING SIGNATURES

RELATED APPLICATION

This application is a continuation-in-part of application Ser. No. 08/034,360, filed Mar. 19, 1993, by Stephen R. Kleinhen and entitled "Apparatus for Stacking Signatures", now U.S. Pat. No. 5,312,233. The benefit of the earlier filing date of the aforementioned application has been and hereby is claimed for all common subject matter.

BACKGROUND OF THE INVENTION

The present invention relates to a new and improved apparatus for use in handling signatures and more specifically to an apparatus which conveys stacks of signatures from a platform.

An apparatus which receives signatures, forms groups or intermediate stacks of signatures and deposits the intermediate stacks of signatures on a main stack of signatures is disclosed in U.S. Pat. No. 4,068,567, issued Jan. 17, 1978 and entitled "Combined Ejector-Gate Means for Rotatable Table of an Article Counter-Stacker". The apparatus disclosed in this patent includes a stacker which receives newspapers. The newspapers are stacked on cooperating pairs of upwardly angled blades carried on endless chains. A stack supporting table is disposed beneath the stacker and receives stacks of newspapers from the stacker.

The stack supporting table disposed beneath the stacker of the apparatus disclosed in the aforementioned U.S. Pat. No. 4,068,567, is rotatable to offset relatively thick folded edge portions of newspapers received from the stacker. A pair of combination gate and ejector mechanisms have bars which are moved by a pair of chains to engage the ends of stacks of newspapers on the turntable. The bars push the stack of newspapers onto roller conveyors. Apparatus for use in forming stacks of signatures are also disclosed in U.S. Pat. Nos. 3,532,230; 3,599,807; 4,183,704; and 4,678,387.

An apparatus for tying loose stacks of signatures is disclosed in U.S. Pat. No. 4,611,533 issued Sep. 16, 1986 and entitled "Tying Apparatus". This apparatus includes an inlet conveyor which receives signatures in a lapped stream. The lapped stream of signatures is formed into a loose stack and deposited at a central station in the apparatus. A shuttle assembly sequentially moves loose stacks of signatures from the central station to either a right tying station or a left tying station. The loose stacks of signatures are bound or tied at the tying stations by strapping machines. The bound or tied stacks of signatures are then delivered to a receiving station.

SUMMARY OF THE INVENTION

The present invention relates to a new and improved apparatus for use in handling signatures. The apparatus may include longitudinally extending signature support elements, referred to herein as slats. One of the slats of a first plurality of slats cooperates with one of the slats of a second plurality of slats to support signatures. A jogger assembly may be used to jog signatures supported by the slats. A platform may be disposed beneath the slats and jogger assembly to receive the signatures.

An improved conveyor assembly has pusher elements which sequentially engage stacks of signatures to push them from the platform. The pusher elements may move the stacks of signatures into a strapper assembly or other apparatus. As a stack of signatures is moved into the strapper assembly or other apparatus, a leading end portion of the stack of signatures engages a registration surface. A pusher element presses the signatures against the registration surface to align opposite ends of the stack of signatures and to locate the stack of signatures relative to the strapper assembly or other apparatus. After the strapper assembly has tied the stack of signatures, the pusher element pushes the stack of signatures away from a tying station in the strapper assembly.

BRIEF DESCRIPTION OF THE DRAWINGS

The foregoing and other features of the invention will become more apparent upon a consideration of the following description taken in connection with the accompanying drawings wherein.

DESCRIPTION OF ONE SPECIFIC PREFERRED EMBODIMENT OF THE INVENTION

General Description

Figure 1:
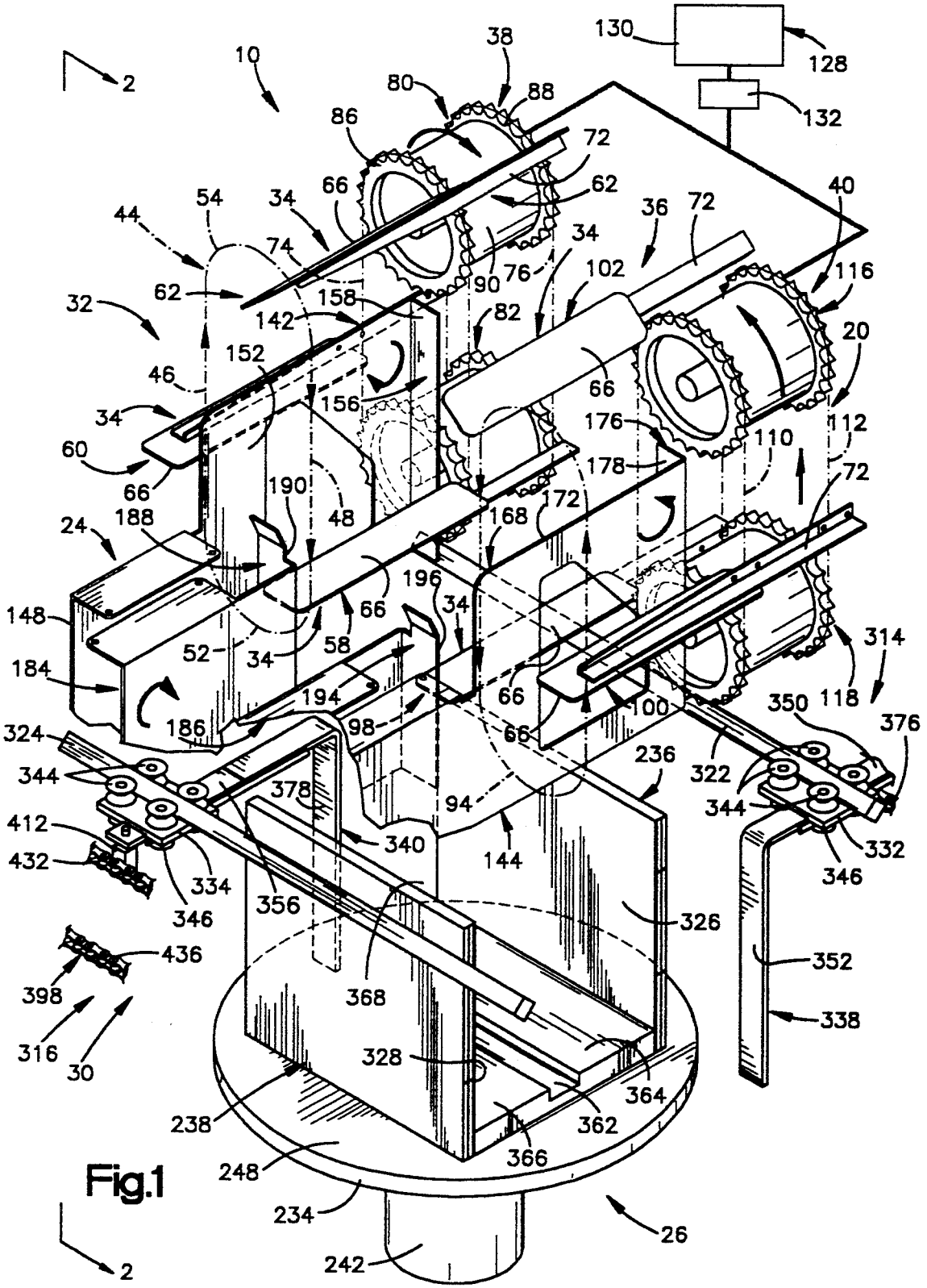
FIG. 1 is a highly schematicized illustration of an apparatus constructed in accordance with the present invention and schematically depicting the relationship between a stacker assembly, a jogger assembly, a turntable, and a conveyor assembly.

An apparatus 10 for use in handling signatures is illustrated schematically in FIG. 1. The apparatus 10 receives signatures 12 (FIG. 2) from an infeed conveyor 14 in a stream 16. The signatures 12 are conducted in the stream 16 with folded edge portions of the signatures leading and open edge portions of the signatures trailing. The signatures 12 are advantageously formed into a group or intermediate stack 18 in a stacker assembly 20.

Figure 2:
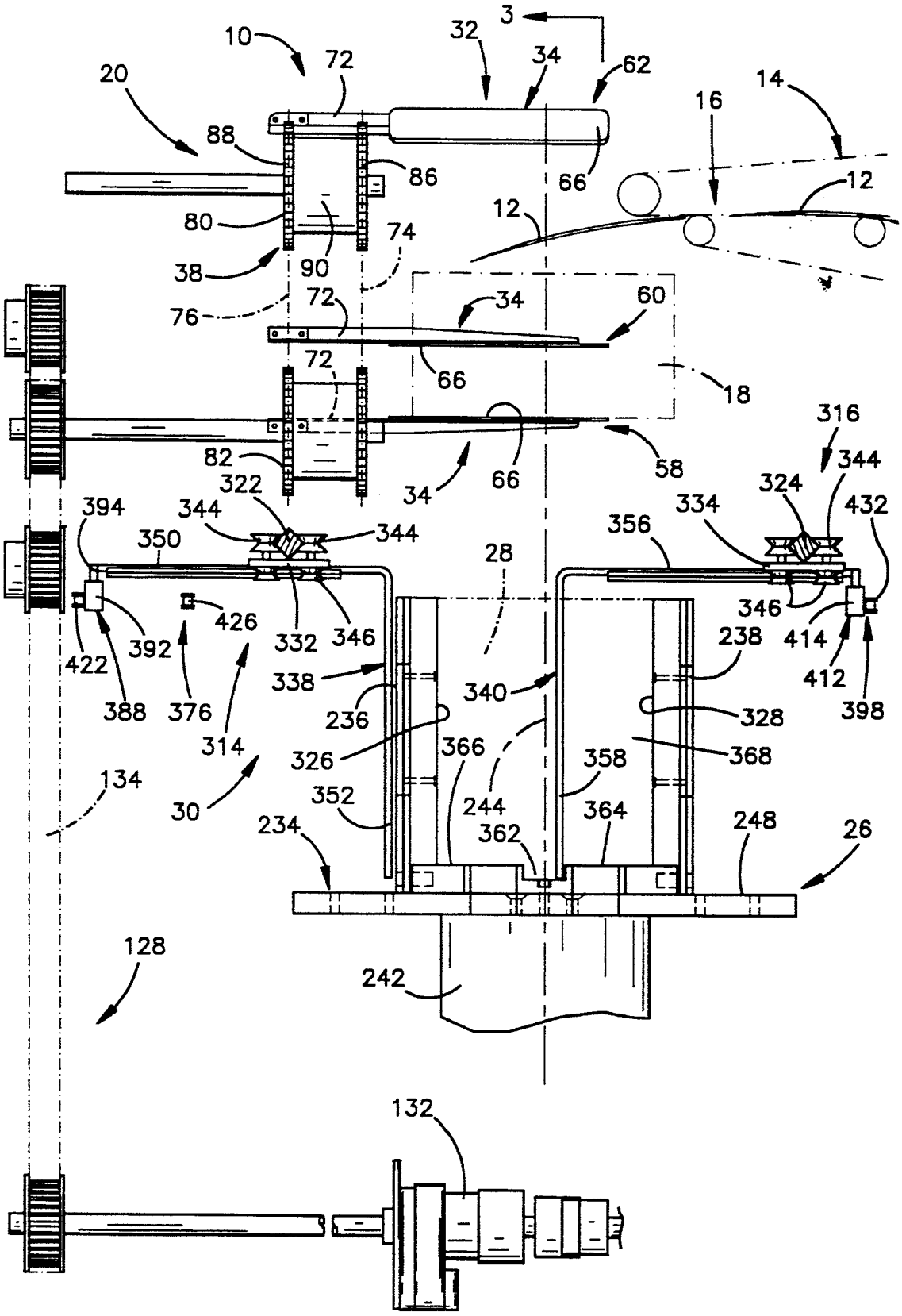
FIG. 2 is a side elevational view, taken generally along the line 2—2 of FIG. 1, illustrating the manner in which a stream of signatures is fed into the stacker assembly and the relationship of the stacker assembly to the turntable and conveyor assembly.
Figure 3:
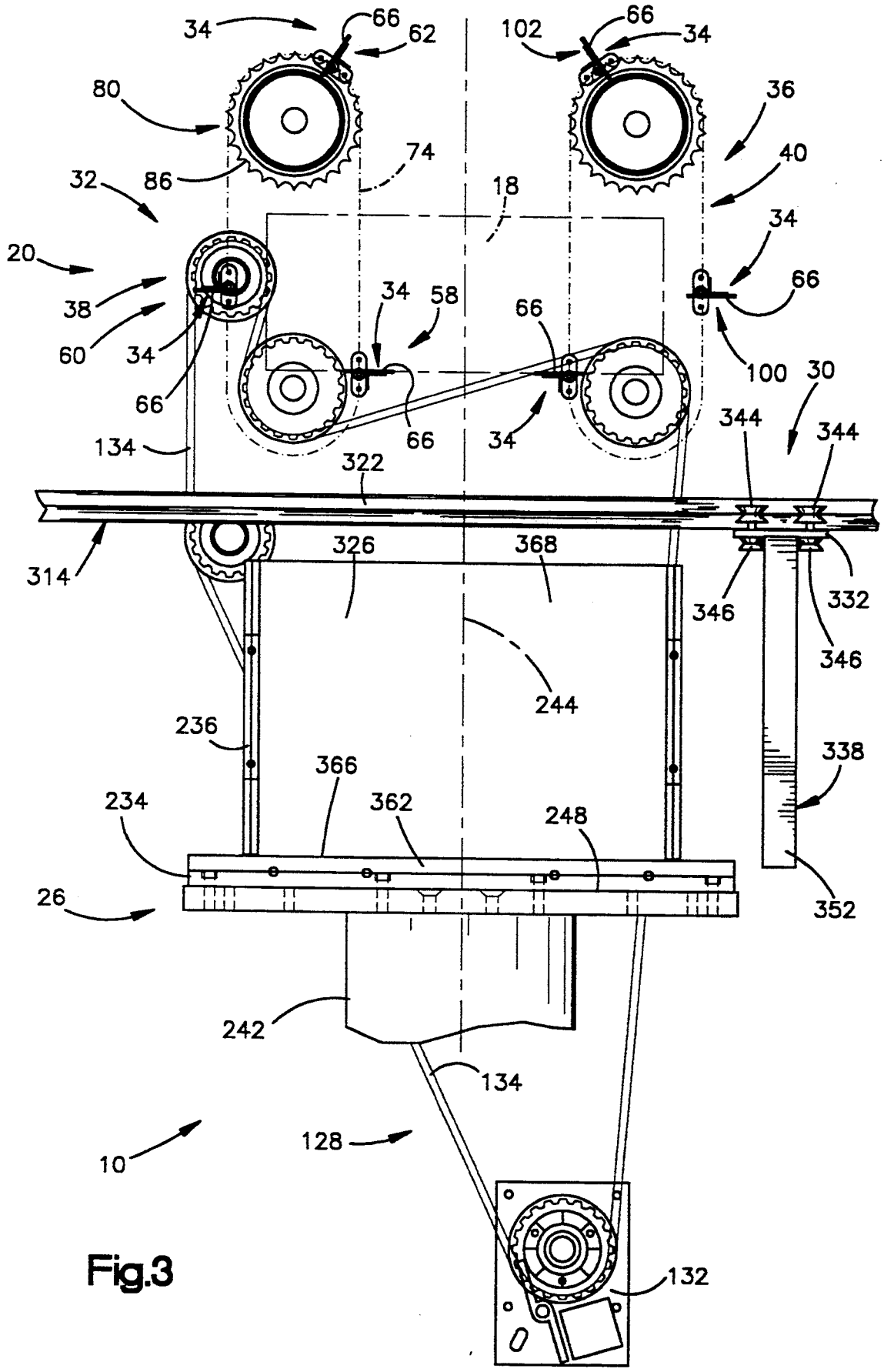
FIG. 3 is an elevational view, taken generally along the line 3—3 of FIG. 2, further illustrating the relationship between the stacker assembly, turntable, and conveyor assembly.

While the group or intermediate stack 18 of signatures is supported in the stacker assembly 20, it is preferred to have a jogger assembly 24 (FIGS. 1) jog the group or intermediate stack (FIG. 2) of signatures to align opposite edge portions of the signatures in the intermediate stack of signatures. Thus, as the group or intermediate stack 18 of signatures is formed in the stacker assembly 20, the jogger assembly 24 (FIG. 1) is continuously operated to align the edge portions of the signatures. After the group or intermediate stack 18 of signatures has been formed in the stacker assembly 20, the group or intermediate stack of signatures is deposited onto a receiving platform, which, in the illustrated embodiment of the invention, is a turntable 26 (FIGS. 2 and 3). The group or intermediate stack 18 of signatures is received on a main stack 28 (FIG. 2) of signatures on the turntable 26.

Each time a group or intermediate stack 18 of signatures is deposited on the turntable 26 by the stacker assembly 20, the turntable 26 rotates the main stack 28 through one-half of a revolution. By rotating the main stack 28 through one-half of a revolution each time a group or intermediate stack 18 of signatures is deposited on the main stack, the relatively thick folded edge portions of the signatures in the groups or intermediate stacks are offset from each other. This results in the main stack 28 of signatures being composed of layers of signatures having folded edge portions in one layer of signatures offset by 180° from the folded edge portions of the next succeeding layer of signatures. Therefore, the upper side of the main stack 28 of signatures is generally horizontal so that the main stack of signatures is relatively stable.

Figure 5:
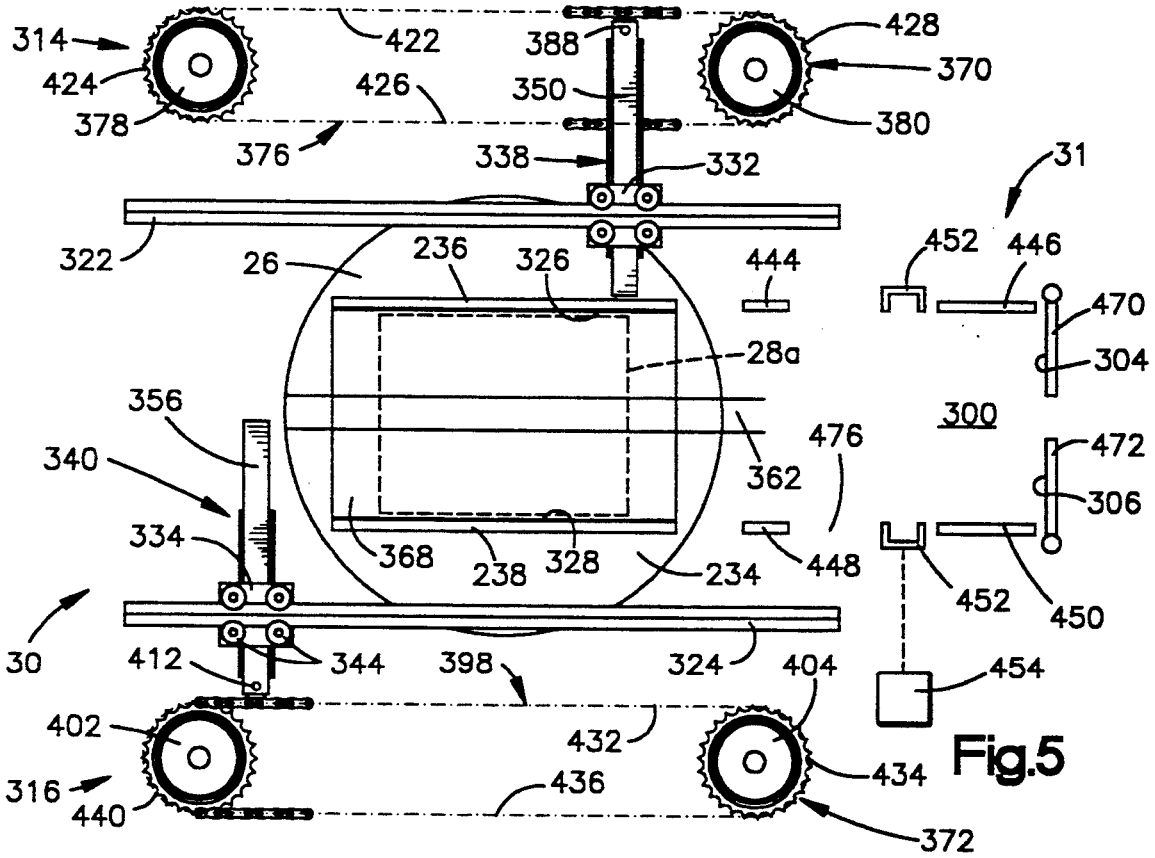
FIG. 5 is a highly schematicized plan view illustrating the relationship of pusher elements in the conveyor assembly to a stack of signatures on the turntable and to a strapper assembly.

An improved conveyor assembly 30, constructed and operated in accordance with one of the features of the invention, is provided to sequentially move main stacks 28 of signatures from the turntable 26 to a strapper assembly 31 (FIG. 5). Thus, after a sufficient number of groups or intermediate stacks 18 (FIG. 2) of signatures have been deposited on the turntable 26 by the stacker assembly 20 to form a main stack 28 of a desired size, the main stack is removed from the turntable 26 for tying in the strapper assembly 31. It should be understood that the conveyor assembly 30 may be used to sequentially move stacks 28 of signatures to apparatus other than the strapper assembly 31 if desired.

A main stack 28 of signatures can be completely removed from the turntable 26 in substantially less time then is required to form a group or intermediate stack 18 of signatures. It is contemplated that it may be desired to eliminate the accumulation of groups or intermediate stacks 18 on the turntable 26 and the formation of a relatively large main stack 28. If this is the case, the turntable 26 may be replaced by a stationary platform. The conveyor assembly 30 would be operated to move each group or intermediate stack 18 off of the platform in turn to the strapper assembly 31 or other apparatus before the next succeeding group or intermediate stack is received on the platform.

Stacker Assembly

The infeed conveyor 14 (FIG. 2) feeds signatures 12 to the stacker assembly 20 in a stream 16 with folded edge portions of the signatures leading. The signatures 12 are supported in the stacker assembly 20 until sufficient signatures have accumulated to form an intermediate stack 18 of a desired size. A completed intermediate stack 18 of signatures is then transferred from the stacker assembly 20 to the turntable 26 and a next succeeding intermediate stack of signatures started without interrupting the stream 16 of signatures.

The stacker assembly 20 includes a first plurality 32 (FIG. 1) of longitudinally extending signature support elements 34, hereinafter referred to as slats. The stacker assembly 20 also includes a second plurality 36 of slats 34. Each of the slats 34 of the first plurality 32 of slats is moved along a circuitous path by a first drive assembly 38. Each of the slats 34 of the second plurality 36 of slats is moved along a circuitous path by a second drive assembly 40.

The first drive assembly 38 moves each of the slats 34 in the first plurality 32 of slats along a first circuitous path, which has been indicated at 44 in FIG. 1. The first circuitous path 44 has a vertical left or outer run 46 along which the slats 34 of the first plurality 32 of slats move vertically upwardly. In addition, the circuitous path 44 has a vertical right or inner run 48 along which the slats 34 of the first plurality 32 of slots move vertically downwardly. A lower semi-circular connector portion 52 interconnects the lower ends of the outer and inner runs 46 and 48 of the circuitous path 44. A semi-circular upper section 54 interconnects the upper ends of the outer and inner runs 46 and 48.

The first drive assembly 38 is operable to intermittently move the slats 34 in a clockwise direction (as viewed in FIG. 1) along the circuitous path 44 between a loading position, indicated at 58 in FIGS. 1 and 3, an intermediate position indicated at 60 in FIGS. 1 and 3, and a standby position indicated at 62 in FIGS. 1 and 3. The first drive assembly 38 is operable to quickly index the slats 34 between loading position 58, intermediate position 60 and standby position 62. The longitudinal central axes of the slats 34 are maintained horizontal and parallel to each other at all times during movement of the slats along the first circuitous path 44 (FIG. 1).

When a slat 34 is in the loading position 58 (FIGS. 1 and 3), a flat front side surface 66 on the slat 34 is horizontal and faces upwardly. When the slat 34 has been moved along the first circuitous path 44 to the intermediate position 60, the flat front side surface 66 of the slat is also horizontal. However, at this time, the front side surface 66 of the slat 34 faces downwardly (see FIGS. 1 and 3). When the slat 34 has been moved to the standby position 62, the longitudinal central axis of the slat is still horizontal. However, at this time, the flat front side surface 66 on the slat 34 is sloped at an angle of approximately 45° to a horizontal plane (FIG. 3).

Inner end portions 72 (FIGS. 1 and 2) of the slats 34 of the first plurality 32 of slats are connected to the first drive assembly 38. In the illustrated embodiment of the invention, the first drive assembly 38 includes a pair of flexible drive elements or chains 74 and 76 (FIGS. 1 and 2). The chains 74 and 76 move along a circuitous path which is of the same size and orientation as the circuitous path 44 and which is coextensive with a portion of the circuitous path 44. It should be understood that although chains 74 and 76 have been used in the first drive assembly 38, it is contemplated that the chains 74 and 76 could be replaced by a single relatively wide belt if desired. Of course, a pair of belts could also be used if desired.

The chains 74 and 76 extend around upper and lower sprocket wheel assemblies 80 and 82 (FIGS. 1 and 2). The upper sprocket wheel assembly 80 includes a pair of sprockets 86 and 88 (FIG. 4) which are interconnected by a cylindrical hub 90. The lower sprocket wheel assembly 82 has the same construction as the upper sprocket wheel assembly 80. The sprocket wheel assemblies 80 and 82 are rotatable about horizonal axes which are disposed in a vertical plane.

The inner end portions 72 of the slats 34 are fixedly connected to the chains 74 and 76 (FIGS. 2). The chains 74 and 76 support the slats 34 in a cantilevered relationship. Thus, the slats 34 extend horizontally outwardly from the chains 74 and 76 to free end portions. The chains 74 and 76 move along the circuitous path 44 to move the inner end portions 72 of the slats 34 along the circuitous path.

The slats 34 in the second plurality 36 of slats are moved along a continuous circuitous path indicated schematically at 94 in FIG. 1. The continuous circuitous path 94 has the same configuration and orientation as the continuous circuitous path 44. The slats 34 are moved along the continuous circuitous path 94 in a counterclockwise direction between a loading position 98, an intermediate position 100 and a standby position 102 (FIGS. 1 and 3). These positions correspond to and are horizontally aligned with the loading position 58, intermediate position 60 and standby position 62 for the first plurality 32 of slats 34.

During movement of the slats 34 of the second plurality 36 of slats along the continuous circuitous path 94 (FIG. 1), the longitudinal axes of the slats 34 are maintained horizontal and parallel to the longitudinal axes of the slats 34 in the first plurality 32 of slats. When a slat 34 in the second plurality 36 of slats is at the loading position 98, a flat front side surface 66 (FIGS. 1 and 3) of the slat is horizontal and faces upwardly. When a slat 34 has been moved from the loading position 98 to the intermediate position 100, the front surface 66 is still horizontal. However, at this time, the front surface 66 faces downwardly. When the slat 34 is moved to the standby position 102, the surface 66 slopes at an angle of approximately 45° to a horizontal plane.

A slat 34 which is at the loading position 58 has a horizontal front side surface 66 which is disposed in the same plane as the horizontal front side surface of a slat at the loading position 98 (FIG. 3). The slats 34 at the loading positions 58 and 98 are spaced apart by a horizontal distance which is less than the length of a folded edge portion of a signature 12. The signatures 12 are fed into the stacker assembly 20 at a location which is above the slats 34 at the loading positions 58 and 98 (FIGS. 2 and 3). Therefore, the signatures are supported on the upwardly facing coplanar front side surfaces 66 of the slats 34 at the loading positions 58 and 98 (FIG. 3).

When sufficient signatures 12 have been accumulated on the slats at the loading positions 58 and 98, the first and second drive assemblies 38 and 40 are operated to quickly index the slats 34 along the circuitous paths 44 and 94 (FIG. 1). As the slats 34 move downwardly from the loading positions 58 and 98, they are moved away from each other and rotated to deposit an intermediate stack 18 on the main stack 28 of signatures on the turntable 26. Thus, the vertical outer runs of the circuitous paths 44 and 94 (FIG. 1) are spaced apart by a horizontal distance which is greater than the length of the folded edge portions of the signatures 12 (FIGS. 1, 2 and 3).

The second drive assembly 40 has the same construction as the first drive assembly 38 and is connected with the slats 34 of the second plurality 36 of slats in the same manner as in which the first drive assembly 38 is connected with the slats of the first plurality 32 of slats. Thus, the second drive assembly 40 includes a pair of chains 110 and 112 (FIG. 1) corresponding to the chains 74 and 76 in the first drive assembly 38. The chains 110 and 112 along a circuitous path which is of the same size and orientation as the circuitous path 94 and which is coextensive with a portion of the circuitous path 94.

The chains 110 and 112 in the second drive assembly 40 extend around upper and lower sprocket wheel assemblies 116 and 118. The sprocket wheel assemblies 116 and 118 are rotatable about horizontal axes. The horizontal axes about which the sprocket wheel assemblies 116 and 118 rotate are disposed in a vertical plane which is parallel to a vertical plane containing horizontal axes about which the upper and lower sprocket wheel assemblies 80 and 82 of the first drive assembly 38 are rotatable.

The end portions 72 of the slats 34 of the second plurality 36 of slats are connected with the chains 110 and 112 in the same manner as previously described for the slats of the first plurality 32 of slats. The slats 34 of the second plurality 36 of slats are supported in a cantilevered relationship from the chains 110 and 112 with their longitudinal central axes horizontal and parallel to each other. The longitudinal axes of the slats 34 in the second plurality 36 of slats are maintained in a parallel relationship with the horizontal longitudinal axes of the slats in the first plurality 32 of slats and with the horizontal axes about which the sprocket wheel assemblies 80, 82, 116 and 118 rotate during movement of the slats along the circuitous paths 44 and 94 (FIG. 1).

The slats 34 in the first plurality 32 of slats and drive chains 74 and 76 move in a clockwise direction (as viewed in FIG. 1) around the circuitous path 46. The slats 34 in the second plurality 36 of slats and drive chains 110 and 112 move in a counterclockwise direction (as viewed in FIG. 1) around the circuitous path 94. Movement of the slats 34 in the first plurality 32 of slats is coordinated with the movement of the slats in the second plurality 36 of slats. The slats 34 in the first and second pluralities 32 and 36 of slats simultaneously move downward toward the loading positions 58 and 98 with the front side surfaces 66 of the slats horizontal and disposed in the same plane. This enables a slat 34 in the first plurality 32 of slats and a slat 34 in the second plurality 36 of slats to cooperate with each other to lower signatures as the two slats move downwardly to their respective loading positions 58 and 98. In addition, once the two slats have reached their respective loading positions 58 and 98, the slats are stationary and cooperate with each other to support the signatures while an intermediate stack 18 of signatures 12 of a desired size is accumulated on the two slats.

A main drive system 128 (FIGS. 1, 2 and 3) is connected with the drive assemblies 38 and 40. The main drive system 128 includes a main drive motor 130 (FIG. 1) which is connected with the drive assemblies 38 and 40 through a single revolution clutch 132. The single revolution clutch 132 (FIGS. 2 and 3) drives a main drive belt 134. The drive belt 134 is intermittently driven to operate the drive assemblies 38 and 40.

Operation of the drive assemblies 38 and 40 simultaneously indexes the slats 34 in the first plurality 32 of slats and the slats in the second plurality of slats 36 between the loading positions 58 and 98, intermediate positions 60 and 100 and standby positions 62 and 102 (FIG. 3). The slats 34 are indexed by the drive assemblies 38 and 40 along the circuitous paths 44 and 94 (FIG. 1). The slats 34 are then stopped while an intermediate stack 18 (FIG. 3) of signatures accumulates on a pair of slats 34 disposed at the loading positions 58 and 98.

After the slats have been stationary for a sufficient length of time to enable a group or intermediate stack 18 of signatures 12 of a desired height to accumulate on the slats at the loading positions 58 and 98, the single revolution clutch 132 effects operation of the drive assemblies 38 and 40 to again index the slats 34. This results in the group or intermediate stack 18 of signatures being deposited on the turntable 26 as a pair of slats 34 move away from the loading positions 58 and 98 and a next succeeding pair of slats move quickly from the standby positions 62 and 102 to the loading positions. It should be noted that the slats 34 can be readily moved into the stream 16 (FIG. 2) of signatures 12 from the infeed conveyor 14 with minimum disturbance. This is because the slats 34 are of a relatively small width as measured on the front side surfaces 66 and perpendicular to the longitudinal central axes of the slats.

Although many different types of single revolution clutches 132 could be used, in one specific embodiment of the invention, the single revolution clutch 132 was obtained from Warner Electric and was a Super CB-6 wrap spring clutch. Warner Electric has a place of business at Beloit, Ill. It should also be understood that an intermittent drive mechanism other than a single revolution clutch could be used if desired.

Although the stacker assembly 20 could have many different constructions, the stacker assembly is constructed and operated in the manner disclosed in U.S. patent application Ser. No. 08/034,360, filed Mar. 19, 1993 By Stephen R. Kleinhen and entitled "Apparatus for Stacking Signatures" now U.S. Pat. No. 5,312,223.

Jogger Assembly

The jogger assembly 24 (FIG. 1) cooperates with the stacker assembly 20 to jog an intermediate stack 18 of signatures while the intermediate stack of signatures is supported by slats 34. The jogger assembly 24 includes a pair of side plates 142 and 144. The side plate 142 extends into the central portion of the circuitous path 44 (FIG. 1). The side plate 144 extends into the central portion of the circuitous path 94. The slats 34 in the first plurality 32 of slats are moved around the side plate 142 along the continuous circuitous path 44 by the first drive assembly 38. Similarly, the slats 34 in the second plurality 36 of slats are moved around the side plate 144 along the continuous circuitous path 94 by the second drive assembly 40. The loading positions 58 and 98 (FIG. 3) and the vertical inner runs of the circuitous paths 44 and 94 (FIG. 1) are disposed between the side plates 142 and 144.

The side plate 142 of the jogger assembly 24 includes a vertical side section 148 (FIG. 1). The side section 148 extends parallel to the longitudinal axes of the slats 34 of the first plurality 32 of slats.

The side section 148 of the jogger side plate 142 has a flat vertical side surface 152 (FIG. 1) which extends parallel to the longitudinal axes of the slats 34 of the first plurality 32 of slats. The side surface 152 of the jogger side plate 142 is engageable with one end of an intermediate stack 18 of signatures supported in the stacker assembly 20. The side surface 152 is reciprocated toward and away from the end of the intermediate stack 18 of signatures to jog the end portions of the signatures into alignment with each other.

A vertical end section 156 of the jogger side plate 142 extends perpendicular to the side section 148. The end section 156 of the side plate 142 has a flat vertical side surface 158 which is engageable with a side of the intermediate stack 18 of signatures. The side surface 158 on the end section 156 engages the side of the intermediate stack 18 of signatures. The side surface 158 is reciprocated toward and away from the side of the intermediate stack 18 of signatures to jog the folded edge portions of the signatures into alignment with each other.

The side plate 144 of the jogger assembly 24 has a construction which is similar to the construction of the side plate 142. Thus, the side plate 144 includes a side section 168 having a flat vertical side surface 172. The side surface 172 on the side section 168 extends parallel to the side surface 152 on the side section 148 of the jogger side plate 142. The side surface 172 on the side section 168 of the jogger side plate 144 is parallel to the longitudinal axes of the slats 34 in the second group 36 of slats throughout movement of the slats along the circuitous path 94 (FIG. 1). The vertical portions of the circuitous paths 44 and 94 along which the slats 34 move downwardly are disposed between the jogger side plates 142 and 144.

An end section 176 on the jogger side plate 144 (FIG. 1) extends perpendicular to the side section 168. The end section 176 has a flat vertical side surface 178 disposed in the same plane as the vertical side surface 158 on the end section 156 of the side plate 142. The side surface 178 is reciprocated toward and away from the side of the intermediate stack 18 of signatures to jog the folded edge portions the signatures into alignment with each other.

The flat side, surface 172 (FIG. 1) on the side section 168 is engageable with an end of an intermediate stack 18 opposite from the end which is engaged by the side surface 152 on the side section 148 of the side plate 142. The side surface 178 disposed on the end section 176 of the side plate 144 is engageable with the side surface of the intermediate stack 18 of signatures which is the same as the side surface of the intermediate stack which is engaged by the side surface 158 on the end section 156. The folded edge portions of the signatures 12 are engaged by the end sections 156 and 176.

In addition to the side plates 142 and 144, the jogger assembly 24 has a pair of back plates 184 and 186 (FIG. 1). The back plates 184 and 186 are disposed outwardly from free end portions of the cantilevered slats 34 disposed at the loading positions 58 and 98.

The back plate 184 has an end section 188 with a flat vertical side surface 190 (FIG. 1) which extends parallel to the flat side surface 158 on the end section 156 of the side plate 142. The side surface 190 on the end section 188 of the back jogger plate 184 is engageable with a side of an intermediate stack 18 of signatures supported by the stacker assembly 20. The side surface 190 on the jogger back plate 124 is reciprocated toward and away from the side of the intermediate stack 18 opposite from the folded edge portions of the signatures 12 to jog the open edge portions of the signatures into alignment with each other.

The jogger back plate 186 has an end section 194 with a flat vertical side surface 196. The side surface 196 on the end section 194 of the jogger plate 186 is disposed in the same vertical plane as the side surface 190 on the end section 188 of the jogger back plate 184. The side surface 196 is engageable with the same side of an intermediate stack 18 of signatures as is the side surface 190. The side surface 196 on the jogger back plate 186 is reciprocated toward and away from the side of the intermediate stack 18 opposite from the folded edge portions of the signatures 12 to jog the open edge portions of the signatures into alignment.

The side surfaces 190 and 196 on the jogger back plates 184 and 186 are engageable with a side of an intermediate stack 18 opposite from a side engaged by the side surfaces 158 and 178 on the jogger side plates 148 and 168. The side surface 196 on the jogger back plate 186 extends parallel to the side surface 178 on the end section 176 of the jogger side plate 144 and to the vertical plane 124. The side surfaces 190 and 196 on the jogger back plates 184 and 186 are disposed in a vertical plane which is perpendicular to the longitudinal axes of the slats 34 in the loader assembly 20 and parallel to the vertical plane 124.

A pair of drive assemblies (not shown) are provided to oscillate the jogger plates 142, 144, 184 and 186. The drive assemblies effect movement of the side sections 148 and 168 (FIG. 1) of the jogger side plates 142 and 144 toward and away from opposite ends of an intermediate stack of signatures supported by the stacker assembly 20. In addition, the drive assemblies effect movement of the end sections 156 and 176 of the jogger side plates 142 and 144 toward and away from the side of the intermediate stack 18 which extends between the opposite ends of the stack.

The jogger side plates 142 and 144 are reciprocated toward and away from the jogger back plates 84 and 86. The jogger side plates 142 and 144 are also reciprocated toward and away from each other. This enables the jogger side plates 142 and 144 to align signature edges at opposite ends of an intermediate stack and along one side of an intermediate stack closest to the vertical plane 124. The jogger back plates 184 and 186 cooperate with the side plates 142 and 144 to align edges of signatures on opposite sides of an intermediate stack of signatures supported in the stacker assembly 20.

Although the drive assemblies for the jogger plates 142, 144, 184 and 186 could have many different constructions, the drive assemblies are constructed and operated in the manner disclosed in U.S. patent application Ser. No. 08/034,360, filed Mar. 19, 1993 by Stephen R. Kleinhen and entitled "Apparatus for Stacking Signatures" now U.S. Pat. No. 5,312,233.

Turntable

The turntable 26 is disposed beneath the slats 34 of the stacker assembly 20 and the jogger plates 142, 144, 184 and 186 of the jogger assembly 24. The turntable 26 receives groups or intermediate stacks 18 of signatures (FIG. 2) from the stacker assembly 20. The turntable 26 rotates a main stack 28 through one-half of a revolution to offset the folded edges of an intermediate stack 18 from the folded edges of the next succeeding intermediate stack. This results in the main stack being relatively level and stable.

The turntable 26 has a rotatable circular platform 234 (FIG. 2). A pair of upstanding, parallel guide walls 236 and 238 (FIG. 1) are disposed on the platform 234. The guide walls 236 and 238 engage a main stack 28 of signatures to hold the stack in position on the platform 234 during rotation of the platform. The walls 236 and 238 also engage opposite sides of a main stack 28 of signatures to guide the initial portion of movement of the main stack 28 off of the turntable 26 by the conveyor assembly 30.

It is contemplated that pivotal end walls or flaps may be mounted at opposite ends of the guide walls 236 and 238 to retain the main stack 28 of signatures against movement relative to the turntable 26. The end wall or flaps (not shown) may be pivoted relative to the guide walls 236 and 238 by suitable pneumatic piston and cylinder assemblies to move the flaps to an open position to enable a stack 28 of signatures to be moved from between the guide walls 236 and 238.

A drive assembly 242 (FIG. 1) is connected to a central portion of the platform 234 (FIGS. 2 and 3). The drive assembly 242 is operable to rotate the platform 234 about a vertical axis which extends through the center of an intermediate stack 18 supported in the stacker assembly 20. Thus, the platform 234 is rotatable about a vertical central axis 244 (FIGS. 2 and 3) which extends through the center of the main stack 28 and through the center of the intermediate stack 18 supported by the stacker assembly 20 above the turntable 26.

The vertical central axis 244 of the circular turntable platform 234 is disposed midway between the circuitous paths 44 and 94 and midway between a pair of slats 34 disposed at the loading positions 58 and 98 (FIG. 3). The central axis 244 of the turntable 26 extends parallel to the vertical side surfaces 152 and 172 (FIG. 1) on the side sections 148 and 168 of the jogger side plates 142 and 144. The central axis 244 of the turntable is disposed midway between the side surfaces 152 and 172 on the jogger side plates 142 and 144. In addition, the central axis 244 of the turntable 26 extends parallel to and is disposed midway between the side surfaces on the end sections 156 and 176 of the jogger side plates 142 and 144 and the side surfaces 190 and 196 on the jogger back plates 184 and 186.

The platform 234 has a flat circular upwardly facing side surface 248 which is disposed in a horizontal plane and extends parallel to the longitudinal axes of the slats 34 in the stacker assembly 20 (FIG. 2). The flat upper side surface 248 of the turntable 26 supports the main stack 28 of signatures for rotation about the central axis 244 of the turntable.

The drive assembly 242 is operable to rotate the turntable 26 about the central axis 244 to offset the folded edge portions of succeeding groups or intermediate stacks 18 of signatures deposited on the main stack 28 of signatures on the turntable 26. To offset the folded edge portions of the groups or intermediate stacks 18 of signatures relative to the main stack 28, the drive assembly 242 is operable to rotate the platform 234 through 180° immediately after one group or intermediate stack 18 of signatures is deposited on the turntable 26 and before the next succeeding intermediate stack is deposited on the turntable.

Although the drive assembly 242 (FIG. 1) could be constructed in such a manner as to sequentially rotate the turntable through 180° increments in the same direction, the drive assembly is constructed so as to sequentially rotate the turntable through 180° increments in opposite directions. Thus, the drive assembly 242 rotates the platform 234 in a clockwise direction (as viewed in FIG. 1) through 180° before one group or intermediate stack 18 of signatures is deposited on the platform. The drive assembly 242 then rotates the platform 234 through 180° in a counterclockwise direction (as viewed in FIG. 1) before the next succeeding group or intermediate stack 18 of signatures is deposited on the platform.

It may be desired to eliminate the compensation for the thick folded edge portions of the signatures 12. In this situation, the turntable may be replaced by a stationary platform or the turntable drive assembly 242 may be temporarily rendered inactive.

The turntable drive assembly 242 could have many different constructions. However, the turntable drive assembly 242 is constructed and operated in the manner disclosed in the aforementioned U.S. patent application Ser. No. 08034,360, filed Mar. 19, 1993 by Stephen R. Kleinhen and entitled "Apparatus for Stacking Signatures" now U.S. Pat. No. 5,312,223.

Conveyor Assembly—General Description

The conveyor assembly 30 is operable to move a stack 28 of signatures from the turntable 26 to a work or tying station 300 (FIGS. 5 and 6) in the strapper assembly 31. As the stack 28 of signatures moves into the strapper assembly 31, the conveyor assembly 30 presses the leading end of a stack 28 against registration surfaces 304 and 306 in the strapper assembly 31 to align the leading edge portions of the signatures (FIG. 7) and position the stack relative to the tying station 300. The strapper assembly 31 is then operated to tie a band 310 (FIG. 8) around the stack 28 of signatures. The conveyor assembly 30 then moves the tied stack of signatures away from the work or tying station 300 in the strapper assembly 31.

Figure 7:
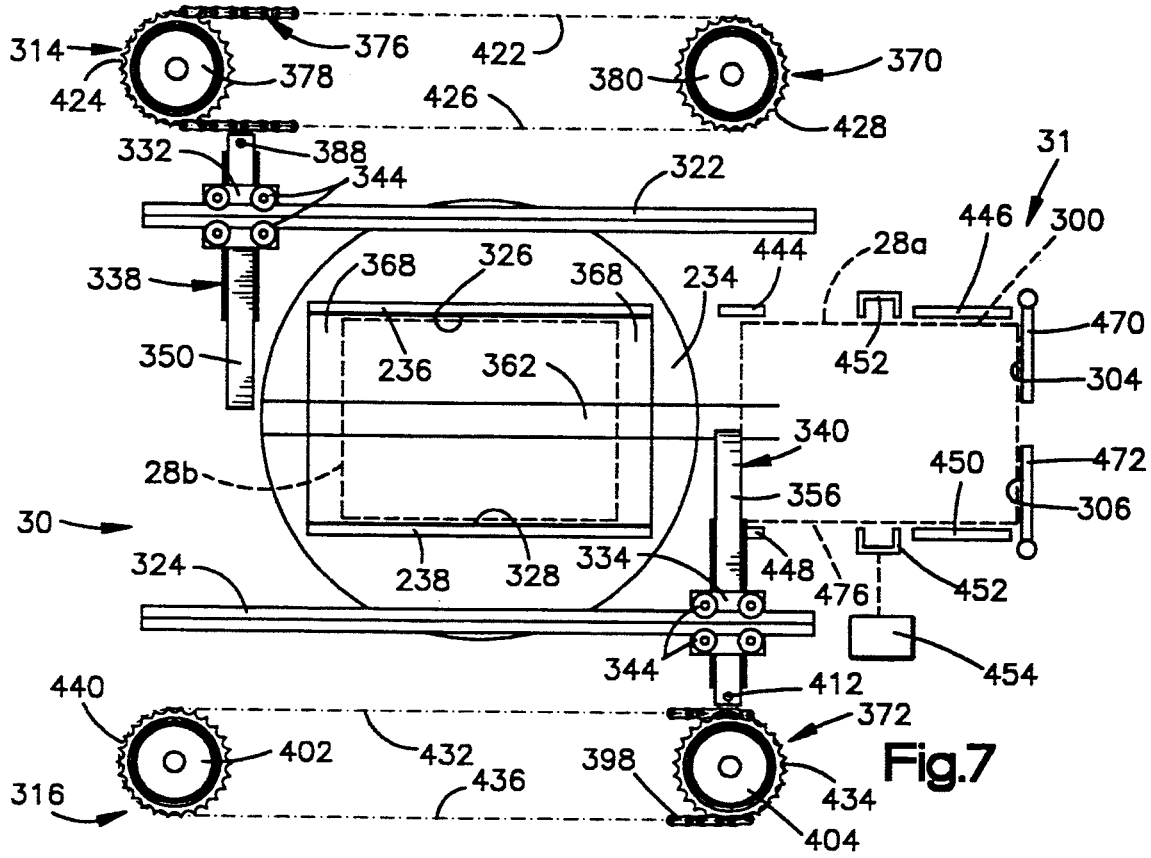
FIG. 7 is a schematic illustration, generally similar to FIGS. 5 and 6, illustrating the manner in which the pusher element presses the leading end portion of a stack of signatures against registration surfaces in the strapper assembly.

The conveyor assembly 30 includes a unit 314 and a unit 316 (FIGS. 1, 2, 4, and 5). The units 314 and 316 of the conveyor 30 are disposed above the turntable 26 and below the stacker assembly 20 and jogger assembly 24 (FIG. 1). The units 314 and 316 cooperate to sequentially move main stacks 28 of signatures to the strapper assembly 31. Thus, the unit 316 of the conveyor assembly 30 will move a first stack **28*a* (FIG. 5) from the turntable 26 along a linear discharge path to the strapper assembly 31 (FIG. 7). The unit 314 of the conveyor assembly 30 will move the next succeeding stack 28*b* from the turntable 26 along the discharge path to the strapper assembly 31**.

The units 314 and 316 of the conveyor assembly 30 (FIG. 4) include a pair of parallel linear rails 322 and 324. The rails 322 and 324 extend parallel to the discharge path along which the stacks 28 of signatures are moved to the strapper assembly 31. The rails 322 and 324 have longitudinal central axes which extend perpendicular to the longitudinal central axes of the slats 34 (FIG. 1) in the first and second pluralities 32 and 36 of slats. In addition, the longitudinal central axes of the rails 322 and 324 extend perpendicular to the side surfaces 152 and 172 on the side plates 142 and 144 in the jogger assembly 24. When the turntable 26 is stationary in a position to receive a group or intermediate stack 18 of signatures from the stacker assembly 20 (FIG. 1), the longitudinal central axes of the rails 322 and 324 extend parallel to flat vertical inner side surfaces 326 and 328 on the guide walls 236 and 238.

An inner carriage 332 and an outer carriage 334 are movable back and forth along the rails 322 and 324. Pusher elements 338 and 340 (FIG. 4) are connected with the carriages 332 and 334 for movement therewith along the rails 322 and 324. In addition, the pusher elements 338 and 340 are movable relative to the carriages 332 and 334 between extended and retracted positions.

Although the conveyor assembly 30 is described herein as moving a stack 28 of signatures toward the right (as viewed in FIGS. 5–8) from the turntable platform 234, the direction of operation of the conveyor assembly could be reversed to move a stack of signatures toward the left. It is preferred to use the conveyor assembly 30 to sequentially move stacks of signatures into the strapper assembly 31. However, the conveyor assembly 30 could be used to move stacks of signatures in other known stack processing devices, such as a trimmer.

Conveyor Assembly—Pusher Elements

Figure 4:
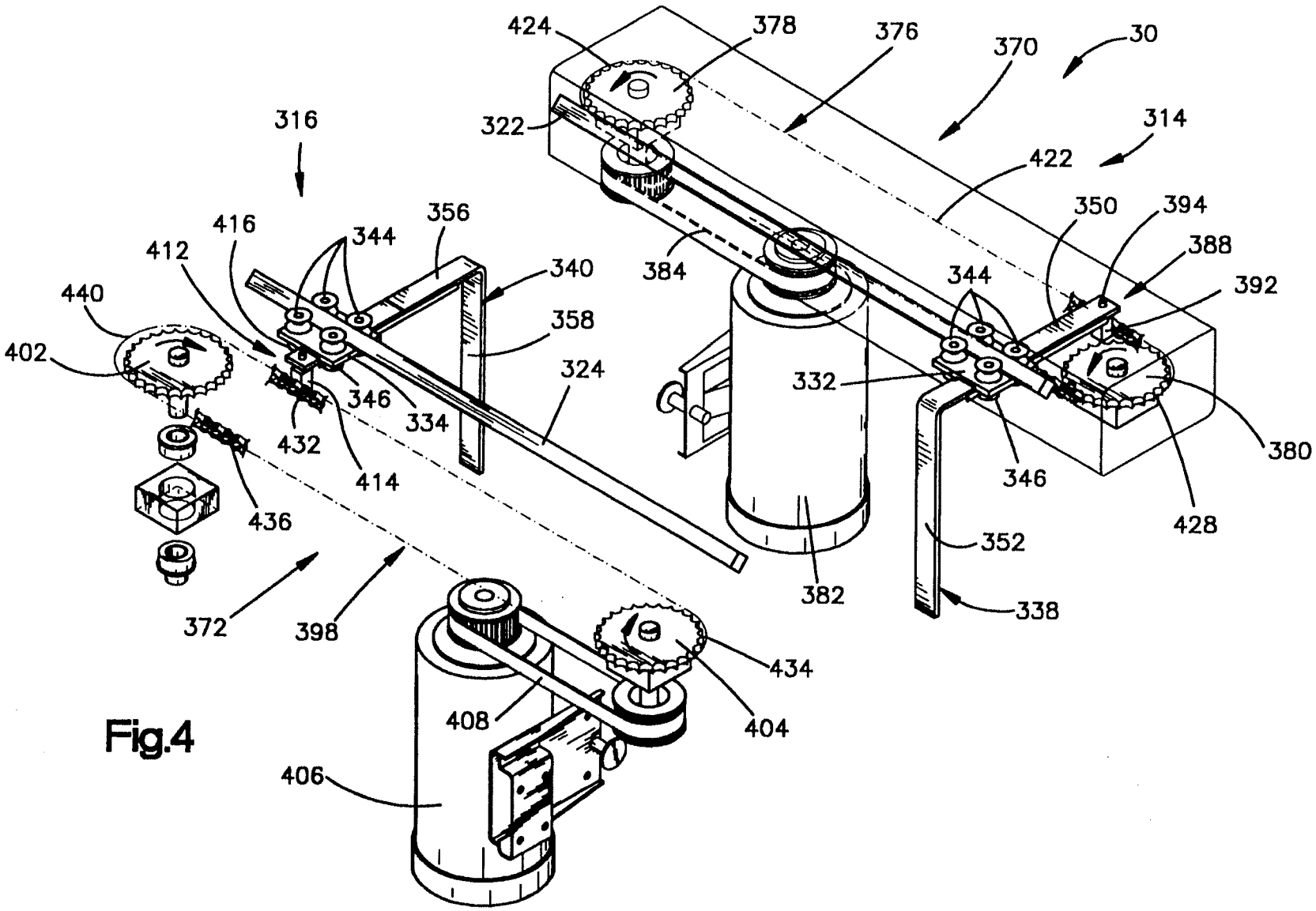
FIG. 4 is a partially broken away schematicized pictorial illustration of the conveyor assembly.
Figure 8:
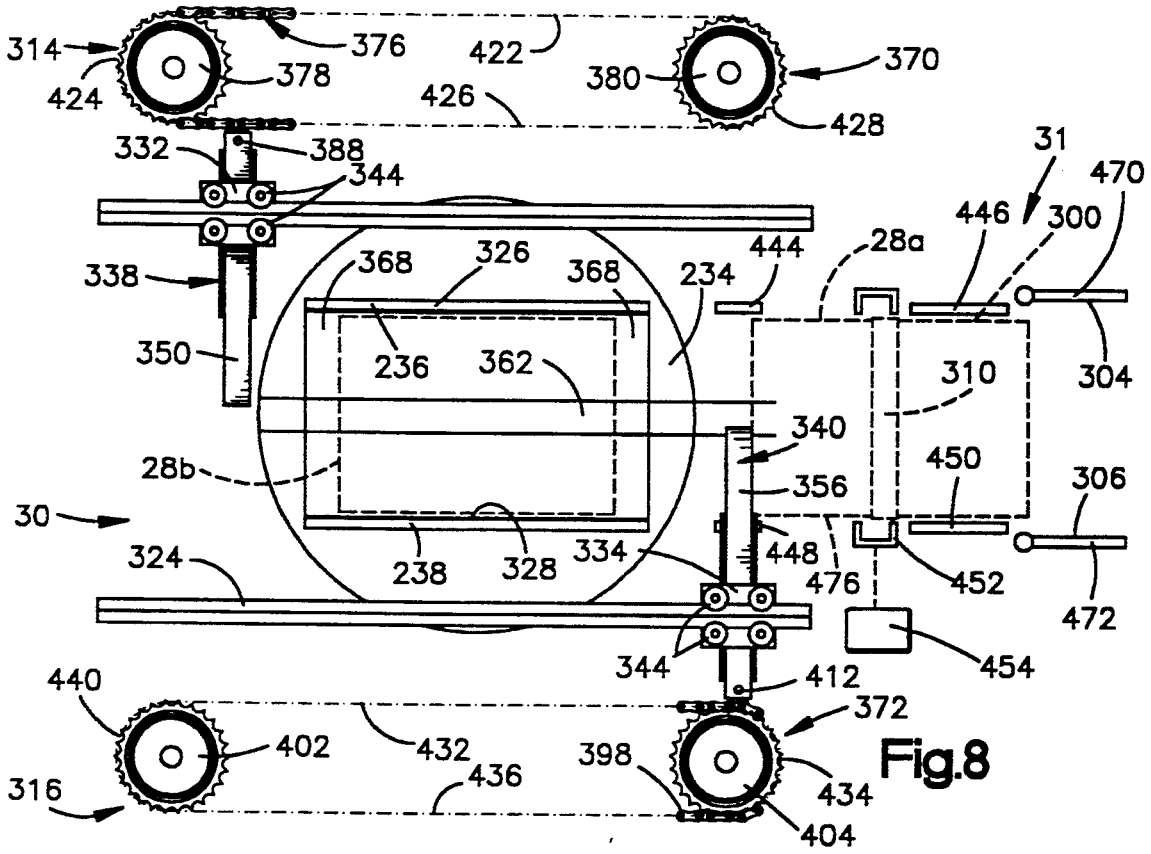
FIG. 8 is a schematic illustration, generally similar to FIGS. 5–7, illustrating the manner in which the pusher element pushes a tied stack of signatures away from a tying station in the strapper assembly.

When the pusher element 338 is in the extended position shown in FIGS. 7 and 8, the pusher element 338 extends outwardly from the carriage 332. When the pusher element 338 is in the retracted position (FIGS. 4, 5 and 6), the pusher element 338 does not extend as far outward from the carriage 332. Similarly, when the pusher element 340 is in the extended position (FIGS. 4–8), the pusher element 340 extends outward from the carriage 334. When the pusher element 340 is in the retracted position, the pusher element 340 is adjacent to the rail 324 in the same manner as in which the pusher element 338 is adjacent to the rail 322 when the pusher element 338 is retracted (FIG. 4).

Suitable rollers are provided on the carriages 332 and 334 to guide movement of the carriages along the rails 322 and 324 and to guide movement of the pusher elements 338 and 340 relative to the carriages. Thus, guide rollers 344 on the upper side of the carriages 332 and 334 (FIG. 4) guide movement of the carriages along the rails 322 and 324. Guide rollers 346 on the lower sides of the carriages 332 and 334 guide movement of the pusher elements 338 and 340 relative to the carriages.

When the pusher elements 338 and 340 are in their extended positions, they are utilized to sequentially push stacks 28 of signatures from the turntable 26 into the strapper assembly 31. Thus, the extended pusher element 340 is movable along the track 324 into engagement with the left (as viewed in FIG. 5) end portion of the stack **28*a*. Continued movement of the extended pusher element 340 along the track 324 (FIG. 6) pushes the stack 28*a* of signatures into the strapper assembly 31 (FIG. 7**).

As the stack **28*a* of signatures is pushed into the strapper assembly 31, the leading or right (as viewed in FIG. 7) end portion of the stack 28*a* engages the registration surfaces 304 and 306 in the strapper assembly 31. Movement of the pusher element 340 is then interrupted. This positions the stack 28*a* relative to the strapper assembly 31. In addition, engagement of the leading end portion of the stack 28*a* with the registration surfaces 304 and 306 tends to move any misaligned signatures in the stack into alignment. At the same time, engagement of the pusher element 340 with the trailing end portion of the stack 28*a*** tends to further promote movement of any misaligned signatures into alignment.

Cooperation between the stationary pusher element 340 and the registration surfaces 304 and 306 ensures that the signatures in the stack **28*a* are in alignment when the band 310 (FIG. 8) is applied to the stack by the strapper assembly 31. After the band 310 has been applied to the stack 28*a*, the pusher element 340 continues to move forward to push the tied stack 28*a* at least part way out of the strapper assembly 31 (FIG. 8). The pusher element 340 remains in engagement with the stack 28*a* from the time the pusher element engages the stack on the turntable 26 until the stack is pushed out of the strapper assembly 31**.

As the pusher element 340 pushes a stack **28*a* of signatures out of the strapper assembly 31, the pusher element is moved to its retracted position. When the pusher element 340 is in its retracted position, it is moved to a position closely adjacent to the rail 324, in the manner shown for the pusher element 338** in FIGS.

4 and 5. The pusher element is then moved back (leftwardly as viewed in FIG. 8) along the rail 324.

When the pusher element 340 has moved to the left (as viewed in FIG. 5) of the turntable 26, the pusher element is again extended. The extended pusher element 340 is then moved back toward the right to the initial or home position shown in FIG. 5. When the pusher element 340 is stopped at the initial or home position (FIG. 5), the pusher element is in its extended position and is adjacent to the turntable 26 in readiness to engage a next succeeding stack of signatures.

The pusher element 338 moves along the rail 322 in the same manner as in which the pusher element 340 moves along the rail 324. Thus, the pusher element 338 is moved to the right (as viewed in FIGS. 7 and 8) along the rail 322 with the pusher element 338 is in its extended position. This pushes the next succeeding stack 28*b* of signatures into the strapper assembly 31. After the stack 28*b* has been tied in the strapper assembly 31, the pusher element 338 pushes the stack away from the tying station 300. Only one pusher element 338 or 340 engages a stack 28 at a time.

The pusher element 338 (FIGS. 1, 2 and 4) includes a horizontal transverse section 350 which is engaged by the carriage 332. The pusher element 338 has a vertical main section 352 which extends downwardly from the transverse section 350. The main section 352 of the pusher element is engageable with a stack of signatures.

The pusher element 340 has the same construction as the pusher element 338. Thus, the pusher element 340 has a horizontal transverse section 356 which is engaged by the carriage 334. A vertical main section 358 extends downwardly from the transverse section 356. The main section 358 of the pusher element 340 is engageable with a stack of signatures.

Lower end portions of the main sections 352 and 358 (FIG. 2) of the pusher elements 338 and 340 are sequentially moved along a channel 362 which extends across the center of the turntable 26 into the strapper assembly 31. The channel 362 is disposed midway between and extends parallel to the rails 322 and 324 (FIG. 5). The stack 28 of signatures is supported beneath the stacker 20 on raised surfaces 364 and 366 on the turntable platform 234. The stack 28 of signatures is held on the turntable platform 234 in a rectangular chamber 368 formed by the side walls 236 and 238. The central axis 244 (FIGS. 2 and 3) of the turntable 26 extends through the center of the chamber 368 and is disposed halfway between the rails 322 and 324.

The lower end portion of the main section 352 or 358 of a pusher element 338 or 340 which engages a stack 28 of signatures extends into the channel 362 (FIG. 2) to be certain that the lowermost signature in the stack 28 is engaged by the pusher element. Thus, the lower end portion of the main section 358 of the pusher element 340 is shown in FIG. 2 aligned with the channel 362. When the pusher element 340 is moved along the rail 324 to push a stack 28 of signatures, the lower end portion of the main section 358 of the pusher element will move along the channel 362. By having the main section 358 of the pusher element 340 extend into the channel 362, the pusher element is engageable with the lowermost signature in a stack 28 of signatures. The pusher element 338 cooperates with the channel 362 in the same manner as the pusher element 340. Conveyor Assembly—Drive Assemblies The units 314 and 316 of the conveyor assembly 30 have drive assemblies 370 and 372 (FIG. 4) which are sequentially operable to move the pusher elements 338 and 340 and carriages 332 and 334 along the rails 322 and 324. The drive assembly 370 includes a continuous chain 376 which extends around a pair of sprocket wheels 378 and 380 which are rotatable about vertical axes. A reversible electric motor 382 is connected with the sprocket wheel 378 by a drive belt 384 to rotate the sprocket wheel 378 to thereby move the chain 376 along a continuous circuitous path.

A connector assembly 388 pivotally interconnects an end of the transverse section 350 of the pusher element 338 and the chain 376. The connector assembly 388 includes a generally rectangular base 392 (FIG. 4) which is secured to the chain 376. An upstanding pin 394 extends through an opening in the transverse section 350 of the pusher element 338. The base 392 and pin 394 are pivotal relative to the transverse section 350 of the pusher element 358.

Similarly, the drive assembly 372 includes a continuous chain 398 which extends around a pair of sprocket wheels 402 and 404 which are rotatable about vertical axes by a reversible electric drive motor 406. The drive motor 406 is connected with the sprocket wheel 404 by a drive belt 408.

A connector assembly 412 (FIG. 4) interconnects the chain 398 and the pusher element 340. The connector assembly 412 includes a generally rectangular base 414 which is connected to the chain 398. An upstanding pin 416 pivotally connects the transverse 414 with the base section 356 of the pusher element 340.

During operation of the motor 382 to operate the drive assembly 370, the chain 376 moves the connector assembly 388 toward the left along a linear run 422 to move the pusher element 338 and carriage 332 toward the left (as viewed in FIG. 4) with the pusher element retracted. The linear runs 422 and 426 of the chain 376 extend parallel to the rail 322. When the connector assembly 388 reaches the sprocket wheel 378 at the left end portion of the linear run 422, the connector element moves along an arcuate run 424 of the chain 336 which extends around the sprocket wheel 378. As this occurs, the connector assembly 388 moves toward the rail 322 and the pusher element 338 is extended.

Continued operation of the motor 382 then moves the connector assembly 388 toward the right along a linear run 426 (FIG. 5) of the chain 376 with the pusher element 338 in the extended position. The linear runs 422 and 426 of the chain 376 extend parallel to the rail 322. When the connector assembly 388 reaches the right (as viewed in FIG. 5) end of the linear run 426 of the chain 376, the connector assembly 388 is moved along an arcuate run 428 of the chain 376 extending around the sprocket wheel 380 (FIG. 4). As the connector assembly 388 moves around the sprocket wheel 380, the pusher element 338 is moved from its extended position back to its retracted position.

The chain 398 (FIG. 4) in the drive assembly 372 moves the connector assembly 412 along a continuous circuitous path having a linear run 432 which extends parallel to the rail 324. Thus, the pusher element 340 and carriage 334 are moved from a position adjacent to the left end (as viewed in FIG. 4) of the rail 324 to a position disposed adjacent to the right end of the rail as the motor 406 is operated to rotate the sprocket wheel 404 in a clockwise direction. As this occurs, the extended pusher element 340 pushes a stack 28 toward the strapper assembly 31.

An arcuate run 434 of the continuous chain 398 extends around the sprocket wheel 404 and connects the linear run 432 with a second linear run 436. The linear runs 432 and 436 extend parallel to the rail 324. As the connector assembly 412 moves along the arcuate run 434 around the sprocket wheel 404, the pusher element 340 is moved relative to the carriage 334 from the extended position to a retracted position. Continued operation of the motor 406 moves the connector assembly 412 along the linear run 436 of the chain 398 with the pusher element 340 in the retracted position. As this occurs, a retracted pusher element 340 and carriage 334 are moved from a position adjacent to the right end (as viewed in FIG. 4) of the rail 324 back to a position adjacent to the left end of the rail 324.

An arcuate run 440 of the chain 398 extends around the left (as viewed in FIG. 4) sprocket wheel 402 and interconnects the linear runs 436 and 432. As the connector assembly 412 is moved along the arcuate run 440 of the chain, the connector assembly moves the pusher element 340 from the retracted position to the extended position. The connector assembly 412 is then moved through a short distance along the linear run 432 to the initial or home position (FIG. 5) for the pusher element 340.

Strapper Assembly

The strapper assembly 31 includes guide walls 444, 446, 448 and 450 (FIG. 5) which engage side surfaces of a stack 28 of signatures to position the stacks of signatures relative to a strap chute 452. The strap chute 452 has a generally U-shaped cross section. The strap chute 452 extends along a path having a generally rectangular configuration. The strap chute 452 opens inwardly and extends completely around the tying station 300.

A strap feed mechanism, indicated schematically at 454 in FIG. 5, is operable to feed a strap or band 310 (FIG. 8) around the stack 28. Once the strap has been fed around the stack 28, the strap feed mechanism 454 pulls the strap tight and interconnects the ends of the strap. Although the strapper assembly 31 could have many different constructions, in one specific embodiment of the invention, the strapper assembly 31 was a Model JP-80 MFX supplied by Ovalstrapping Inc. having a place of business at 710 8th Street, Hoquiam, Wash. 98550. Of course, other known strapper assemblies provided by other manufacturers could be utilized if desired.

The registration surfaces 304 and 306 are disposed on doors or flaps 470 and 472 in the strapper assembly 31. When the doors 470 and 472 are in their closed positions (FIGS. 5, 6 and 7), the registration surfaces 304 and 306 are parallel to the side surfaces 152 and 172 on the jogger side plates 142 and 144. The doors 470 and 472 are pivotal, by a suitable mechanism (not shown), from the closed position of FIG. 7 to the open position of FIG. 8.

Operation

During operation of the apparatus 10, the infeed conveyor 14 (FIG. 2) conducts a continuous stream 16 of signatures 12 to the stacker assembly 20 with folded edge portions of the signatures leading. As the signatures 12 enter the stacker assembly 20, the folded edge portions of the signatures impact against the end sections 156 and 176 (FIG. 1) on the jogger side plates 142 and 144. Opposite ends of the signatures 12 are engaged by the side surfaces 152 and 172 on the jogger side plates 142 and 144. This aligns the incoming signatures 12 with a partially formed group or intermediate stack 18 (FIG. 2) of signatures supported on a pair of slats 34 at the loading positions 58 and 98 (FIG. 3).

The signatures 12 then move downward toward the upper end of the partially formed group or intermediate stack 18 of signatures. As the signatures 12 move downward, the open trailing edge portions of the signatures engage the end sections 188 and 194 (FIG. 1) on the jogger back plates 184 and 186. The end sections 188 and 194 on the back plates 184 and 186 cause the signatures to move into firm abutting engagement with the end sections 156 and 176 on the jogger side plates 142 and 144.

While a group or intermediate stack 18 of signatures having a desired height is being accumulated on a pair of slats 34 in the stacker assembly 20 (FIG. 3), the turntable drive assembly 242 rotates the turntable platform 234 through 180°. Rotation of the turntable platform 234 results in the folded edge portions of the immediately preceding group or intermediate stack 18 of signatures being moved from a position disposed to the left (as viewed in FIG. 2) of the central axis 244 of the turntable 26 to a position to the right of the turntable axis. Thus, the folded edge portions of the uppermost group or intermediate stack 18 of signatures on the main stack 28 are moved from a position directly beneath the folded edge portions of the group or intermediate stack 18 of signatures being accumulated in the stacker assembly 20 to a position to the right (as viewed in FIG. 2) of the axis 244 and immediately beneath the open edge portions of the signatures being accumulated in the intermediate stack 18 in the stacker assembly 20.

While the signatures 12 are being accumulated in the stacker assembly 20 to form the group or intermediate stack 18 of signatures, the side sections 148 and 168 (FIG. 1) of the jogger side plates 142 and 144 are continuously impacted against opposite ends of the intermediate stack 18 of signatures. The end sections 156 and 176 on the jogger side plates 142 and 144 are continuously impacted against the folded edges of the signatures 12 on one side of the group or intermediate stack 18 of signatures. Similarly, the end sections 188 and 194 of the jogger back plates 184 and 186 are continuously impacted against the open edges of the signatures 12 on an opposite side of the group or intermediate stack 18 of signatures. By continuously jogging the signatures 12 in the group or intermediate stack 18 of signatures, the edge portions of the signatures are accurately aligned with each other to form a group or intermediate stack of signatures with well defined and relatively smooth side and end surfaces.

Once a group or intermediate stack 18 of a desired size has been accumulated on a pair of slats 34 at the loading positions 58 and 98, the single revolution clutch 132 in the main drive system 128 is engaged. The main drive system 128 then operates the drive assembly 38 to index the slats 34 of the first plurality 32 of slats in a clockwise direction along the first circuitous path 44 (FIG. 1). At the same time, the main drive system 128 operates the drive assembly 40 to index the slats 34 in the second plurality 36 of slats in a counterclockwise direction along the second circuitous path 94.

As the slats 34 are moved downwardly from the loading positions 58 and 98, the front side surfaces 66 of the slats are tipped downwardly and moved sidewardly to release the group or intermediate stack 18 of signatures for downward movement toward the turntable 26. As the group or intermediate stack 18 of signatures begins to move downwardly relative to the slats 34, the jogger assembly 24 continuously jogs the ends and sides of the intermediate stack to maintain the signatures 12 in alignment with each other. Thus, the jogger assembly 24 functions to promote alignment of the signatures 12 from the time the signatures are fed into the upper portion of the stacker assembly 20, through the formation of an group or intermediate stack 18, and through at least a portion of the depositing of the intermediate stack on the turntable 26. The guide walls 236 and 238 maintain the signatures 12 in alignment as they are deposited on the turntable platform 234.

As the slats 34 move downwardly and sidewardly away from the loading positions 58 and 98, the next succeeding slats 34 move downwardly from the standby positions 62 and 102. Thus, the main drive system 128 is operable to quickly move the slats 34 downwardly from their standby positions 62 and 102 to a position in which the front surfaces 66 of the slats are immediately beneath the standby positions 62 and 102 and are disposed in a common horizontal plane. Since the slats 34 are relatively long and narrow, the slats can easily move into the stream 16 of signatures with minimal interference.

As the downward movement of the slats 34 along the inner runs of the first and second circuitous paths 44 and 94 is continued, the downwardly facing rear sides of the slats engage the last signature 12 being fed onto the intermediate stack 18. The downwardly moving slats 34 propel this last signature downwardly toward the intermediate stack 18. At the same time, the horizontal upper sides 66 of the slats 34 move into position to receive the next succeeding signature in the stream of signatures. During continued downward movement of the slats 34 away from the standby positions 62 and 102 toward the loading positions 58 and 98, a few signatures are accumulated on the slats 34.

The slats 34 are quickly moved to the loading positions 58 and 98 with their upwardly facing front side surfaces 66 disposed in a common horizontal plane. The operation of the main drive system 128 is then interrupted and the slats 34 remain stationary at the loading positions 58 and 98. As a pair of slats in the first and second pluralities 32 and 36 of slats are moved along the circuitous paths 44 and 94 to the loading positions 58 and 98, the next succeeding slats are moved along the circuitous paths 44 and 94 from the intermediate positions 60 and 100 to the standby positions 62 and 102.

As soon as an intermediate stack 18 of signatures has been deposited on the main stack 28 of signatures on the turntable 26, the turntable drive assembly 242 is again operated. The turntable platform 234 is then rotated back through 180° in a clockwise direction (as viewed in FIG. 1). This results in the folded edge portions of succeeding intermediate stacks 18 of signatures accumulating in the main stack 28 of signatures with their folded edge portions offset by 180° relative to each other. As was previously mentioned, it is contemplated that rotation of the turntable 26 may be eliminated and the stacks of signatures accumulated on a stationary platform 234.

As a stack 28 of signatures is deposited between the guide walls 236 and 238 (FIG. 5) by operation of the stacker assembly 20, the conveyor assembly 30 may be in the condition shown in FIG. 5. At this time, the pusher element 340 and carriage 334 are stationary in their home or initial position adjacent to the left (as viewed in FIG. 5) end of the rail 324. The pusher element 340 is in the extended position for movement into engagement with the next succeeding stack **28*a* of signatures. The pusher element 338 is retracted and is being moved leftwardly (as viewed in FIG. 5) along the rail 322 by the drive assembly 370**.

When the stack **28*a* is of the desired size, that is, when one or more groups or intermediate stacks 18 (FIG. 2) have been deposited on the turntable platform 234, the motor 406 (FIG. 4) in the drive assembly 372 (FIG. 5) begins to move the carriage 334 and the extended pusher element 340 toward the right. As this happens, the lower end of the downwardly extending main section 358 of the pusher element 340 enters the channel 362 (FIG. 2**).

As the drive assembly 372 continues to move the carriage 334 and pusher element 340 toward the right (as viewed in FIG. 5), the downwardly extending main section 358 (FIGS. 2 and 4) of the pusher element 340 moves into engagement with the left (as viewed in FIG. 5) end of the stack **28*a* of signatures. Continued operation of the drive assembly 372 causes the pusher element 340 to push the stack 28*a* of signatures along the flat parallel inner side surfaces 326 and 328 on the guide walls 236 and 238 (FIG. 6) to begin pushing the stack 28 off of the turntable 26**.

Figure 6:
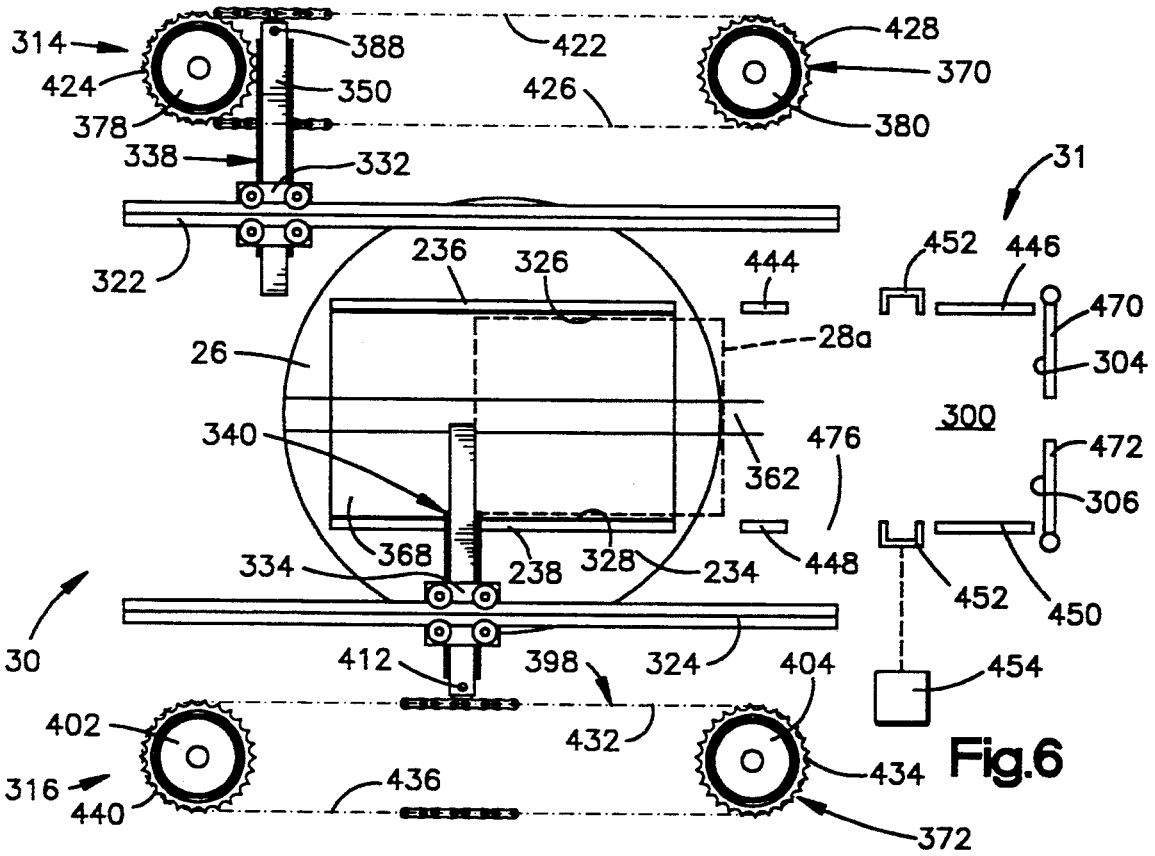
FIG. 6 is a schematic illustration, generally similar to FIG. 5, illustrating the manner in which one of the pusher elements engages a stack of signatures on the turntable to push the stack of signatures toward the strapper assembly;.

At this time, the pusher element 338 will have moved leftwardly along the rail 322 from the position shown in FIG. 5 to the position shown in FIG. 6 by the drive assembly 370. During this movement of the pusher element 338, it is in the retracted position. Therefore, the downwardly extending main section 352 (FIG. 4) of the pusher element 338 moves between the rail 322 and an outer side of the guide wall 236 (FIG. 2). At this time, the downwardly extending main section 352 of the pusher element 338 is disposed outside of the channel 362.

As the operation of the drive assembly 370 continues, the connector assembly 388 moves around the sprocket wheel 378. As this occurs, the pusher element 338 is moved from the retracted position of FIG. 6 to the extended position of FIG. 7. As the pusher element 338 is extended, the main section 352 of the pusher element 358 moves into alignment with the channel 362.

As the pusher element 338 is moving to the extended position shown in FIG. 7, the pusher element 340 is pushing the stack **28*a* along a discharge path toward the strapper assembly 31. As the stack 28*a* begins to move into the strapper assembly 31, the trailing portion of the stack is still between the guide walls 236 and 238. However, the leading portion of the stack 28*a* will have moved between the guide walls 444 and 448 in the strapper assembly 31. Thus, the guide walls 236 and 238 on the turntable 26 are spaced from the guide walls 444 and 448 of the strapper assembly 31 by a distance which is less than the length of the stack 28*a*. This results in the alignment imparted to the signatures in the stack 28*a* by the jogger assembly 24 being maintained by the guide walls 236 and 238 on the turntable 26 and the guide walls 444 and 448 in the strapper assembly 31. In addition, the pusher element 340 is pressed against the trailing edge portion of the stack 28*a*** of signatures to further maintain the alignment of the signatures in the stack.

Continued operation of the drive assembly 372 continues the rightward (as viewed in FIGS. 6 and 7) movement of the carriage 334 and pusher element 340. As this occurs, the stack **28*a* moves out from between the guide walls 236 and 238 and moves into the strapper assembly 31 between the guide walls 446 and 450. The guide walls 446 and 450** cooperate with the stack to maintain the signatures in alignment.

Continued forward movement of the stack 28a moves the leading end of the stack into abutting engagement with the registration surfaces 304 and 306 to position the stack 28a in the strapper assembly 31. Engagement of the leading end of the stack 28a with the registration surfaces 304 and 306 tends to move any signatures which may be slightly out of alignment into alignment. At this time, the pusher element 340 is pressing against the trailing edge portion of the stack 28a of signatures to further promote the alignment of the signatures.

The drive assembly 332 stops the forward movement of the pusher element 340 in the position shown in FIG. 7 with the stack 28a in engagement with the registration surfaces 304 and 306. The strapper assembly 31 is then operated to compress and band the stack 28a in a known manner. As this is occurring, the doors 470 and 472 on which the registration surfaces 304 and 306 are disposed are pivoted from the closed position of FIG. 7 to the open position of FIG. 8.

Upon completion of the tying or strapping of the stack 28a, the drive assembly 372 is operated to move the pusher element 340 to push the tied stack 28a away from the tying station 300 in the strapper assembly 31. Thus, the drive assembly 372 moves the pusher element 340 toward the right to push the leading or rightward end portion of the tied stack 28a out of the tying station 300 onto suitable conveyor (not shown) which continues the movement of the stack 28a out of the strapper assembly 31 to a receiving location. As this is occurring, the lower end of the main section 358 of the pusher element 340 moves out of the channel 362.

As the operation of the drive assembly 372 continues, the connector assembly 412 moves around the sprocket wheel 404 and moves the pusher element from the extended position of FIG. 8 to the retracted position. As this occurs, the main section 358 of the pusher element 340 moves through a space 476 between the strap chute 452 and the side wall 448. As the connector assembly 412 moves rightwardly (as viewed in FIG. 8) around the sprocket wheel 404, the pusher element 340 continues to push the tied stack 28a out of the strapper assembly 31.

Continued operation of the drive assembly 372 with the pusher element 340 in the retracted position moves the carriage 334 and the retracted pusher element 340 leftward (as viewed in FIG. 8) along the rail 324 toward the sprocket wheel 402. As this occurs, the downwardly extending portion 358 of the retracted pusher element 340 moves between the guide wall 238 and the rail 324.

Continued operation of the drive assembly 372 moves the connector assembly 412 around the sprocket wheel 402 to again move the pusher element 340 to the extended position (FIG. 5). When the pusher element 340 has moved rightward to the initial or home position shown in FIG. 5, operation of the drive assembly 372 is interrupted.

After the tied stack 28a of signatures has been moved out of the strapper assembly 31 and the pusher element 340 has been moved to its retracted position by movement of the connector assembly 412 around the sprocket wheel 404, the drive assembly 370 moves the pusher element 338 forward to engage the next succeeding stack 28b of signatures. When the pusher element 338 begins to push the stack 28b of signatures forwardly toward the strapper assembly 31, the retracted pusher element 340 will have been moved back toward the sprocket wheel 402. Therefore, there is no possibility of interference between the next succeeding stack 28b of signatures and the pusher element 340.

The stack 28b of signatures is moved forwardly into engagement with the registration surfaces 304 and 306 in the strapper assembly 31 by the pusher element 338 in the same manner as previously explained in conjunction with the pusher element 340 and the preceding stack 28a of signatures. The pusher elements 338 and 340 alternate in pushing stacks of signatures from the turntable 26 into the strapper assembly 31 at a rate which is determined by the rate of operation of the stacker assembly 20.

If it should be necessary to interrupt operation of the strapper assembly 31 for repairs or other reasons, the direction of operation of the conveyor assembly 30 may be reversed to move the stacks 28 of signatures leftwardly (as viewed in FIGS. 5–8) from the turntable platform 234. Thus, the direction of operation of the motors 382 and 406 (FIG. 4) can be reversed. This enables the conveyor assembly 30 to be used to push stacks of signatures rightwardly (FIGS. 5–8) from the turntable platform 234 to the strapper assembly 31 or leftwardly from the turntable platform to a second strapper assembly (not shown).

It is contemplated that the conveyor assembly 30 may be used with stack processing assemblies other than the strapper assembly 31. Thus, the conveyor assembly 30 could be used to sequentially move stacks of signatures to a work station in any desired type of stack processing apparatus. Although the conveyor assembly 30 advantageously receives signatures from the stacker assembly 20 and jogger assembly 24, it is contemplated that the conveyor assembly 30 could receive signatures from many different types of apparatus. It is also contemplated that the platform 234 could be stationary if desired.

Conclusion

The present invention relates to a new and improved apparatus 10 for use in handling signatures. The apparatus 10 may include longitudinally extending signature support elements 34, referred to herein as slats. One of the slats 34 of a first plurality 32 of slats cooperates with one of the slats of a second plurality 36 of slats to support signatures 12. A jogger assembly 24 is operable to jog signatures supported by the slats 34. A platform 234 is disposed beneath the slats and jogger assembly to receive the signatures.

An improved conveyor assembly 30 has pusher elements 338 and 340 which sequentially engage stacks 28 of signatures to push them from the platform 234. The pusher elements 338 and 340 may move the stacks 28 of signatures into a strapper assembly 31 or other apparatus. As the stack 28 of signatures is moved into the strapper assembly 31 or other apparatus, a leading end portion of the stack of signatures engages a registration surface 304 and 306. A pusher element 338 or 340 presses the signatures against the registration surface 304 and 306 to align opposite ends of the stack 28 of signatures and to locate the stack of signatures relative to the strapper assembly 31 or other apparatus. After the strapper assembly 31 has tied a band 310 around the stack 28 of signatures, the pusher element 338 or 340 pushes the tied stack of signatures away from the tying station 300 in the strapper assembly 31.

Having described the invention, the following is claimed:

1. An apparatus comprising a platform, means disposed above said platform for receiving a stream of signatures, for sequentially forming a plurality of groups of signatures and for depositing each of the groups of signatures in turn on said platform, and conveyor means for sequentially moving stacks of signatures formed by at least one group of signatures relative to said platform, said conveyor means including a first rail, a first carriage movable along said first rail, a first pusher element connected with said first carriage, said first pusher element being movable between an extended position in which said first pusher element extends outward for a first distance from said first carriage and a retracted position in which said first pusher element extends outward from said first carriage for a second distance which is less than said first distance, first drive means for moving said first pusher element and said first carriage along said first rail in a first direction with said first pusher element in the extended position to move,a first stack of signatures relative to said platform along a stack discharge path, said first drive means being operable to move said first pusher element and said first carriage in a second direction along said first rail with said first pusher element in the retracted position and with at least a portion of said first pusher element disposed between said first rail and the stack discharge path, a second rail extending parallel to said first rail with said stack discharge path disposed between said first and second rails, a second carriage movable along said second rail, a second pusher element connected with said second carriage, said second pusher element being movable between an extended position in which said second pusher element extends outward for a first distance from said second carriage and a retracted position in which said second pusher element extends outward from said second carriage for a second distance which is less than the first distance which said second pusher element extends outward from said second carriage, second drive means for moving said second pusher element and said second carriage along said second rail in the first direction with said second pusher element in the extended position to move a second stack of signatures relative to said platform along the stack discharge path, said second pusher element being spaced from the first stack during movement of the first stack along the stack discharge path, said first pusher element being spaced from the second stack during movement of the second stack along the stack discharge path, said second drive means being operable to move said second pusher element and said second carriage in the second direction along said first rail with said second pusher element in the retracted position and with at least a portion of said second pusher element disposed between said second rail and the stack discharge path.

2. An apparatus as set forth in claim 1 wherein said means for receiving a stream of signatures, for sequentially forming a plurality of groups of signatures, and for depositing each of the groups of signatures in turn on said platform includes first and second pluralities of longitudinally extending signature support elements having longitudinally extending central axes, third drive means for moving said first plurality of signature support elements along a first circuitous path with the longitudinal central axes of said first plurality of signature support elements in a parallel relationship throughout movement of said first plurality of signature support elements along the first circuitous path, and fourth drive means for moving said second plurality of signature support elements along a second circuitous path with the longitudinal central axes of said second plurality of signature support elements in a parallel relationship throughout movement of said second plurality of signature support elements along the second circuitous path, one of said signature support elements of said first plurality of signature support elements cooperating with one of said signature support elements of said second plurality of signature support elements to support a group of signatures, said stack discharge path being disposed below said first and second pluralities of signature support elements and having a longitudinal central axis which is perpendicular to the longitudinal central axes of said signature support elements.

3. An apparatus as set forth in claim 2 wherein said means for receiving a stream of signatures, for sequentially forming a plurality of groups of signatures, and for depositing each of the groups of signatures in turn on said platform includes jogger means for jogging each group of signatures in turn while the group of signatures is supported on one of the signature support elements of said first plurality of signature support elements and by one of the signature support elements of said second plurality of signature support elements, said jogger means including a first jogger plate which is engageable with a first end portion of each group of signatures in turn and a second jogger plate which is engageable with a second end portion of each group of signatures in turn, said first jogger plate having a first side surface which is engageable with the first end portion of each group of signatures in turn, said stack discharge path being disposed beneath said first jogger plate and having a longitudinal central axis which extends perpendicular to a plane containing the first side surface of said first jogger plate, said second jogger plate having a second side surface which is engageable with the second end portion of each group of signatures in turn and which extends parallel to the first side surface of said first jogger plate, said stack discharge path being disposed beneath said second jogger plate and having a longitudinal central axis which extends perpendicular to a plane containing the second side surface of said second jogger plate.

4. An apparatus as set forth in claim 3 said apparatus further including strapper means for tying a band around each of the stacks of signatures in turn at a location between the first and second end portions of the groups of signatures in the stacks of signatures while the stacks of signatures are at a tying station in said strapper means, said strapper means including registration surface means for engaging the second end portion of a group of signatures in each of the stacks in turn to sequentially locate each of the stacks relative to said strapper means, said first drive means being operable to press said first pusher element against the first end portion of a group of signatures in the first stack of signatures to press the second end portion of the group of signatures in the first stack of signatures against said registration surface means in said strapper means, said second drive means being operable to press said second pusher element against the first end portion of a group of signatures in the second stack of signatures to press the second end portion of the group of signatures in the second stack of signatures against said registration surface means in said strapper means.

5. An apparatus as set forth in claim 4 wherein said first drive means is operable to move said first pusher element to push the first stack of signatures away from the tying station in said strapper means, said second drive means being operable to move said second pusher element to push the second stack of signatures away from the tying station in said strapper means.

6. An apparatus as set forth in claim 1 wherein said first drive means includes a first flexible drive element movable along a first circuitous path having a first path length which extends parallel to said first rail, a second path length which is spaced further from said first rail than said first path length, first connector means for interconnecting said first pusher element and said first flexible drive element, said first connector means being movable along said first path length of said first circuitous path in the first direction by said first flexible drive element to move said first carriage and said first pusher element along said first rail in the first direction with said first pusher element in the extended position, said first connector means being movable along said second path length of said first circuitous path in the second direction by said first flexible drive element to move said first carriage and said first pusher element along said first rail in the second direction with said first pusher element in the retracted position, said second drive means includes a second flexible drive element which is movable along a second circuitous path having a first linear path length which extends parallel to said second rail, a second path length which is spaced further from said second rail the said first path length of said second circuitous path, second connector means for interconnecting said second pusher element and said second flexible drive element, said second connector means being movable along said first path length of said second circuitous path in the first direction by said second flexible drive element to move said second carriage and said second pusher element along said second rail in the first direction with said second pusher element in the extended position, said second connector means being movable along said second path length of said second circuitous path in the second direction by said second flexible drive element to move said second carriage and said second pusher element along said second rail in the second direction with said second pusher element in the retracted position.

7. An apparatus as set forth in claim 1 further including strapper means for tying a band around each stack of signatures in turn while the stack of signatures is disposed at a tying station in said strapper means, said first drive means being operable to move said first carriage and said first pusher element in the first direction along said first rail with said first pusher element in the extended position to push at least a portion of the first stack of signatures out of said tying station after said strapper means has tied a band around the first stack of signatures, said second drive means being operable to move said second carriage and said second pusher element in the first direction along said second rail with said second pusher element in the extended position to push at least a portion of the second stack of signatures out of said tying station after said strapper means has tied a band around the second stack of signatures.

8. An apparatus as set forth in claim 7 wherein said first drive means is operable to maintain said first pusher element in engagement with the first stack of signatures from the time said first pusher element engages the first stack of signatures until said first pusher element pushes at least a portion of the first stack of signatures out of said tying station, said second drive means is operable to maintain said second pusher element in engagement with the second stack of signatures from the time said second pusher element engages the second stack of signatures until said second pusher element pushes at least a portion of the second stack of signatures out of said tying station.

9. An apparatus as set forth in claim 1 further including means for rotating said platform relative to said conveyor means about a vertical axis which is disposed midway between said first and second rails to offset one group of signatures relative to a next succeeding group of signatures during the forming of a stack of signatures containing more than one group of signatures.

10. An apparatus comprising first and second pluralities of longitudinally extending signature support elements, signature support elements of said first plurality of signature support elements sequentially cooperating with signature support elements of said second plurality of signatures support elements to sequentially support groups of signatures, platform means disposed beneath said first and second pluralities of signature support elements for sequentially receiving groups of signatures from said first and second pluralities of signature support elements to sequentially form stacks of signatures, receiving station means for sequentially receiving stacks of signatures, said receiving station means including registration surface means for engaging a first end portion of each stack of signatures in turn to locate each stack of signatures in turn relative to said receiving station means and conveyor means for moving each stack of signatures in turn from said platform means to said receiving station means, said conveyor means including at least one pusher element for engaging a second end portion of a stack of signatures disposed on said platform means, and drive means for moving said one pusher element to push the engaged stack of signatures from said platform means toward said receiving station means to move the first end portion of the stack of signatures into engagement with said registration surface means at said receiving station means, said drive means being operable to press said one pusher element against the second end portion of the stack of signatures to press the first end portion of the stack of signatures against said registration surface means, said drive means being operable to press said one pusher element against the second end portion of the stack of signatures to push the stack of signatures away from said receiving station means after the first end portion of the stack of signatures has engaged said registration surface means.

11. An apparatus as set forth in claim 10 further including strapper means at said receiving station means for tying a band around each of the stacks of signatures in turn at a location between the first and second end portions of the stacks of signatures.

12. An apparatus as set forth in claim 10 further including drive means for rotating said platform means about a vertical axis which is disposed midway between a longitudinal axis of one of said signature support elements of said first plurality of signature support elements and a longitudinal axis of one of said signature support elements of said second plurality of signature support elements.

13. An apparatus as set forth in claim 10 further including jogger means for jogging the first and second end portions of each of the groups of signatures in turn while the group of signature is supported by one of said signature support elements of said first plurality of signature support elements and one of said signature support elements of said second plurality of signature support elements, said jogger means includes a first jogger plate having a first side surface engageable with the first end portion of each group of signatures in turn, a second jogger plate having a second side surface extending parallel to the first side surface on said first jogger plate and engageable with the second end portion of each group of signatures in turn, and jogger plate drive means for moving said first and second jogger plates toward and away from the first and second end portions of each group of signatures.

14. An apparatus as set forth in claim 10 wherein said platform means includes a first wall section having a first upright inner side surface for engaging a side portion of each of the groups of signatures in turn, and a second wall section having a second upright inner side surface for engaging a side portion of each of the groups of signatures in turn, said side

15. An apparatus comprising first and second pluralities of longitudinally extending signature support elements, signature support elements of said first plurality of signature support elements sequentially cooperating with signature support elements of said second plurality of signature support elements to sequentially support groups of signatures, jogger means for jogging first and second end portions of each of the groups of signatures in turn while the group of signatures is supported by one of said signature support elements of said first plurality of signature support elements and one of said signature support elements of said second plurality of signature support elements, platform means disposed beneath said first and second pluralities of signature support elements and said jogger means for sequentially receiving groups of signatures from said first and second pluralities of signature support elements to form stacks of signatures, conveyor means for engaging the first end portion of at least one group of signatures in a stack of at least one group of signatures to push each of the stacks of signatures in turn with the second end portion of at least one group of signatures leading, strapper means for tying a band around each of the stacks of signatures in turn at a location between the first and second end portions of the stacks of signatures, said conveyor means including first and second pusher elements, and drive means for moving said first pusher element to push against the first end portion of at least one group of signatures in one stack of signatures to move the one stack of signatures from said platform means into said strapper means with the second end portion of the one group of signatures leading and for moving said first pusher element to push the one stack of signatures away from said strapper means after tying of the one stack of signatures by said strapper means, said drive means being operable to move said second pusher element to push against the first end portion of at least one group of signatures in a stack of signatures next succeeding the one stack of signatures to move the next succeeding stack of signatures from said platform means into said strapper means with the second end portion of the one group of signatures in the next succeeding stack of signatures leading and for moving said second pusher element to push the next succeeding stack of signatures away from said strapper means after tying of the next succeeding stack of signatures by said strapper means.

16. An apparatus as set forth in claim 15 wherein said strapper means includes registration surface means for engaging the second end portion of at least the one group of signatures in each of the stacks of signatures in turn to locate each of the stacks of signatures in turn relative to said strapper means, said conveyor means being operable to push the second end portion of at least one group of signatures in each of the stacks of signatures in turn against said registration surface means in said strapper means.

17. An apparatus as set forth in claim 15 further including drive means for rotating said platform means about a vertical axis which is disposed midway between a longitudinal axis of one of said signature support elements of said first plurality of signature support elements and a longitudinal axis of one of said signature support elements of said second plurality of signature support elements.

18. An apparatus as set forth in claim 15 wherein said jogger means includes a first Jogger plate having a first side surface engageable with the first end portion of each group of signatures in turn, a second jogger plate having a second side surface extending parallel to the first side surface on said first jogger plate and engageable with the second end portion of each group of signatures in turn, and jogger plate drive means for moving said first and second jogger plates toward and away from the first and second end portions of each group of signatures.

19. An apparatus as set forth in claim 18 wherein said strapper means includes a registration surface extending parallel to said first and second side surfaces on said first and second jogger plates, said drive means being operable to press said first pusher element against the first end portion of at least the one group of signatures in the one stack of signatures to press the second end portion of at least the one group of signatures in the one stack of signatures against said registration surface in said strapper means.

20. An apparatus as set forth in claim 15 wherein said platform means includes a first wall section having a first upright inner side surface for engaging a side portion of each of the groups of signatures in turn, and a second wall section having a second upright inner side surface for engaging a side portion of each of the groups of signatures in turn, said conveyor means being operable to push each of the stacks of signatures in turn from a location between said first and second wall sections.

21. An apparatus as set forth in claim 15 wherein said conveyor means includes a first rail, a second rail, a first carriage movable along said first rail, a second carriage movable along said second rail, said first pusher element being connected with said first carriage, said first pusher element being movable relative to said first carriage between an extended position and a retracted position, said second pusher element being connected with said second carriage, said second pusher element being movable relative to said second carriage between an extended position and a retracted position, said drive means being operable to move said first carriage and said first pusher element in a first direction along said first rail with said first pusher element in the extended position to push a stack of signatures from said platform means into said strapper means, said drive means being operable to move said first carriage and said first pusher element in a second direction along said first rail with said first pusher element in the retracted position, said drive means being operable to move said second carriage and said second pusher element in the first direction along said second rail with said second pusher element in the extended position to push a stack of signatures from said platform means into said strapper means, said drive means being operable to move said second carriage and said second pusher element in the second direction along said second rail with said second pusher element in the retracted position.

22. An apparatus comprising first and second pluralities of longitudinally extending signature support elements, signature support elements of said first plurality of signature support elements sequentially cooperating with signature support elements of said second plurality of signature support elements to sequentially support groups of signatures, jogger means for jogging first and second end portions of each of the groups of signatures in turn while the group of signatures is supported by one of said signature support elements of said first plurality of signature support elements and one of said signature support elements of said second plurality of signature support elements, platform means disposed beneath said first and second pluralities of signature support elements and said jogger means for sequentially receiving groups of signatures from said first and second pluralities of signature support elements to form stacks of signatures, conveyor means for engaging the first end portion of at least one group of signatures in a stack of at least one group of signatures to push each of the stacks of signatures in turn with the second end portion of at least one group of signatures leading, strapper means for tying a band around each of the stacks of signatures in turn at a location between the first and second end portions of the one group of signatures, said strapper means including registration surface means for engaging the second end portion of at least the one group of signatures in each of the stacks of signatures in turn to locate each of the stacks of signatures in turn relative to said strapper means, said conveyor means being operable to push the second end portion of at least one group of signatures in each of the stacks of signatures in turn against said registration surface means in said strapper means.

23. An apparatus as set forth in claim 22 further including drive means for rotating said platform means about a vertical axis which is disposed midway between a longitudinal axis of one of said signature support elements of said first plurality of signature support elements and a longitudinal axis of one of said signature support elements of said second plurality of signature support elements.

24. An apparatus as set forth in claim 22 wherein said jogger means includes a first jogger plate having a first side surface engageable with the first end portion of each group of signatures in turn, a second jogger plate having a second side surface extending parallel to the first side surface on said first jogger plate and engageable with the second end portion of each group of signatures in turn, and jogger plate drive means for moving said first and second jogger plates toward and away from the first and second end portions of each group of signatures.

25. An apparatus as set forth in claim 22, wherein said conveyor means includes a first pusher element and said drive means is operable to press said first pusher element against the first end portion of at least the one group of signatures in the one stack of signatures to press the second end portion of at least the one group of signatures in the one stack of signatures against said registration surface means in said strapper means.

26. An apparatus as set forth in claim 22 wherein said platform means includes a first wall section having a first upright inner side surface for engaging a side portion of each of the groups of signatures in turn, and a second wall section having a second upright inner side surface for engaging a side portion of each of the groups of signatures in turn, said conveyor means being operable to push each of the stacks of signatures in turn from a location between said first and second wall sections.

27. An apparatus as set forth in claim 22 wherein said conveyor means includes a first rail, a second rail, a first carriage movable along said first rail, a second carriage movable along said second rail, a first pusher element connected with said first carriage, said first pusher element being movable relative to said first carriage between an extended position and a retracted position, a second pusher element being connected with said second carriage, said second pusher element being movable relative to said second carriage between an extended position and a retracted position, said conveyor means being operable to move said first carriage and said first pusher element in a first direction along said first rail with said first pusher element in the extended position to push a stack of signatures from said platform means to said strapper means, said conveyor means being operable to move said first carriage and said first pusher element in a second direction along said first rail with said first pusher element in the retracted position, said conveyor means being operable to move said second carriage and said second pusher element in the first direction along said second rail with said second pusher element in the extended position to push a stack of signatures from said platform means into said strapper means, said conveyor means being operable to move said second carriage and said second pusher element in the second direction along said second rail with said second pusher element in the retracted position.

28. An apparatus as set forth in claim 22 wherein said jogger means includes a first jogger plate having a first side surface engageable with the first end portion of each group of signatures in turn, said first side surface of said first jogger plate extending parallel to said registration surface means in said strapper means, a second jogger plate having a second side surface engageable with the second end portion of each group of signatures in turn, said second side surface of said second jogger plate extending parallel to said first side surface of said first jogger plate and to said registration surface in said strapper means, and jogger plate drive means for moving said first and second jogger plates toward and away from the first and second end portions of each group of signatures.

29. An apparatus as set forth in claim 22 wherein said conveyor means including a first pusher element for engaging a first end portion of a first stack of signatures on said platform means and for pushing the first stack of signatures in a first direction toward said strapper means and a second pusher element for engaging a first end portion of a second stack of signatures on said platform means and pushing the second stack of signatures in the first direction toward said strapper means, said platform means having surface means for defining a channel, said first pusher element being movable in the first direction along said channel with an end portion of said first pusher element in said channel to push the first stack of signatures off of said platform means, said second pusher element being movable in the first direction along said channel with an end portion of said second pusher element in said channel to push the second stack of signatures off of said platform means.

30. An apparatus as set forth in claim 29 further including a drive assembly connected with said platform means and operable to rotate said platform means relative to said conveyor means and change the orientation of said platform means relative to said conveyor means, said channel extending across said platform means and having a first open end at a first edge portion of said platform means and a second open end at a second edge portion of said channel to enable at least one of said pusher elements to enter said first open end of said channel when said platform means is in a first orientation relative to said conveyor means and to enable at least one of said pusher elements to enter said second open end of said channel when said platform means is in a second orientation relative to said conveyor means.

31. An apparatus as set forth in claim 22 wherein said conveyor means includes a first pusher element engageable with a first end portion of a first stack of signatures on said platform means, a second pusher element engageable with a first end portion of a second stack of signatures on said platform means, and a drive assembly connected with said first and second pusher elements, said drive assembly being operable to move said first pusher element relative to said platform means to push the first stack of signatures toward said strapper means and being operable to move said second pusher element relative to said platform means to push the second stack of signatures toward said strapper means.

32. An apparatus as set forth in claim 164 wherein said first pusher element is movable by said drive assembly to push at least a portion of one of the stacks of signatures out of said strapper means after said strapper means has tied a band around the one stack of signatures, said second pusher element being movable by said drive assembly to push at least a portion of another one of the stacks of signatures out of said strapper means after said strapper means has tied a band around the another stack of signatures.

33. An apparatus as set forth in claim 31 wherein said first pusher element is maintained in engagement with the first end portion of the first stack of signatures from the time the first pusher element engages the first stack of signatures on said platform means at least until a second end portion of the first stack of signatures engages said registration surface means in said strapper means, said second pusher element being maintained in engagement with the first end portion of the second stack of signatures from the time the second pusher element engages the second stack of signatures on said platform means at least until a second end portion of the second stack of signatures engages said registration surface means in said strapper means.

34. An apparatus as set forth in claim 31 wherein said conveyor means includes a first rail, a second rail, a first carriage movable along said first rail, said-first pusher element being connected with said first carriage, and a second carriage movable along said second rail, said second pusher element being connected with said second carriage, said drive assembly being connected with said first and second carriages and being operable to move said first and second carriages along said first and second rails.

35. An apparatus as set forth in claim 34 wherein said first and second rails have parallel longitudinal axes which extend perpendicular to said registration surface means in said strapper means.

36. An apparatus as set forth in claim 31 wherein said drive assembly is operable to move said first pusher element into engagement with the first end portion of the first stack of signatures while the second pusher element is maintained in a spaced apart relationship with the first end portion of the first stack of signatures, said drive assembly being operable to move said second pusher element into engagement with the first end portion of the second stack of signatures while the first pusher element is maintained in a spaced apart relationship with the first end portion of the second stack of signatures.

37. An apparatus as set forth in claim 22 wherein said conveyor means includes at least one pusher element for engaging a first end portion of a first stack of signatures and drive means for moving said one pusher element to push the first stack of signatures from said platform means into said strapper means, for interrupting movement of said one pusher element during tying of a band around the first stack of signatures in said strapper means, and for moving said one pusher element to push at least a portion of the first stack of signatures out of said strapper means after a band has been tied around the first stack of signatures.

38. An apparatus as set forth in claim 37 wherein said drive means is operable to maintain said one pusher element in engagement with the first stack of signatures from the time said one pusher element engages the first stack of signatures on said platform means until said one pusher element pushes at least a portion of said first stack of signatures out of said strapper means.

39. An apparatus as set forth in claim 37 further including means for moving said first plurality of signature support elements along a first circuitous path which is at least partially disposed above said platform means and a path along which said one pusher element is moved by said drive means, said second plurality of signature support elements being movable along a second circuitous path which is at least partially disposed above said platform means and the path along which said one pusher element is moved by said drive means.

40. An apparatus as set forth in claim 37 wherein said platform means includes first and second wall sections having inner side surfaces which engage opposite sides of a stack of signatures, said one pusher element including an upright portion and a transverse portion which is connected with said upright portion, said drive means being offset to one side of said first and second wall sections and being connected with said transverse portion of said one pusher element, said drive means being operable to move said upright portion of said one pusher element in a first direction along a first path length which extends between said inner side surfaces of said first and second wall sections to push a stack of signatures from said platform means toward said strapper means, said drive means being operable to retract said upright portion of said one pusher element by moving said upright portion of said one pusher element along a transverse path length extending transversely to the first path length, said drive means being operable to move said upright portion of said one pusher element in a second direction opposite to said first direction along a second path length offset to a side of said first wall section opposite to the inner side surface of said first wall section.

41. An apparatus comprising first and second pluralities of longitudinally extending signature support elements, signature support elements of said first plurality of signature support elements sequentially cooperating with signature support elements of said second plurality of signatures support elements to sequentially support groups of signatures, jogger means for jogging first and second end portions of each of the groups of signatures in turn while the group of signatures is supported by one of said signature support elements of said first plurality of signature support elements and one of said signature support elements of said second plurality of signature support elements, platform means disposed beneath said first and second pluralities of signature support elements and said jogger means for sequentially receiving groups of signatures from said first and second pluralities of signature support elements to form stacks of signatures, conveyor means for engaging the first end portion of at least one group of signatures in a stack of at least one group of signatures to push each of the stacks of signatures in turn with the second end portion of at least one group of signatures leading, and strapper means for tying a band around each of the stacks of signatures in turn when the stack of signatures is at a tying station in said strapper means, said strapper means including a registration surface extending parallel to said first and second side surfaces on said first and second jogger plates, said conveyor means including at least one pusher element engageable with the first end portion of at least one group of signatures in a stack of signatures, and drive means for moving said one pusher element to push a stack of signatures from said platform means toward the tying station in said strapper means, for pressing said one pusher element against the first end portion of at least the one group of signatures in the stack of signatures to press the second end portion of at least the one group of signatures in the stack of signatures against said registration surface in said strapper means, and for moving said one pusher element to move the stack of signatures away from the tying station after the stack of signatures has been tied by said strapper means.

42. An apparatus as set forth in claim 41 further including drive means for rotating said platform means about a vertical axis which is disposed midway between a longitudinal axis of one of said signature support elements of said first plurality of signature support elements and a longitudinal axis of one of said signature support elements of said second plurality of signature support elements.

43. An apparatus as set forth in claim 41 wherein said jogger means includes a first jogger plate having a first side surface engageable with the first end portion of each group of signatures in turn, a second jogger plate having a second side surface extending parallel to the first side surface on said first jogger plate and engageable with the second end portion of each group of signatures in turn, and jogger plate drive means for moving said first and second jogger plates toward and away from the first and second end portions of each group of signatures.

44. An apparatus as set forth in claim 41 wherein said platform means includes a first wall section having a first upright inner side surface for engaging a side portion of each of the groups of signatures in turn, and a second wall section having a second upright inner side surface for engaging a side portion of each of the groups of signatures in turn, said side portions of each group of signatures extending between the first and second end portions of the groups of signatures, said conveyor means being operable to push each of the stacks of signatures in turn from a location between said first and second wall sections.

45. An apparatus comprising first and second pluralities of longitudinally extending signature support elements, signature support elements of said first plurality of signature support elements sequentially cooperating with signature support elements of said second plurality of signatures support elements to sequentially support groups of signatures, jogger means for jogging first and second end portions of each of the groups of signatures in turn while the group of signatures is supported by one of said signature support elements of said first plurality of signature support elements and one of said signature support elements of said second plurality of signature support elements, platform means disposed beneath said first and second pluralities of signature support elements and said jogger means for sequentially receiving groups of signatures from said first and second pluralities of signature support elements to form stacks of signatures, said platform means including a first wall section having a first upright inner side surface for engaging a side portion of each of the groups of signatures in turn, and a second wall section having a second upright inner side surface for engaging a side portion of each of the groups of signatures in turn, said side portions of each group of signatures extending between the first and second end portions of the groups of signatures, conveyor means for engaging the first end portion of at least one group of signatures in a stack of at least one group of signatures to push each of the stacks of signatures in turn from a location between said first and second wall sections with the second end portion of at least one group of signatures leading, said conveyor means includes a first rail disposed adjacent to said first wall section, a second rail disposed adjacent to said second wall section, a first carriage movable along said first rail, a second carriage movable along said second rail, a first pusher element connected with said first carriage and engageable with an end portion of every other stack of signatures received on said platform means from said first and second pluralities of signature support elements, a second pusher element engageable with an end portion of stacks of signatures on said platform means which are not engaged by said first pusher element, said first pusher element being movable relative to said first carriage between an extended position and a retracted position, said second pusher element being movable relative to said second carriage between an extended position and a retracted position, first drive means for moving said first carriage and said first pusher element in a first direction along said first rail with said first pusher element in the extended position to push a stack of signatures from between said inner side surfaces of said first and second wall sections and for moving said first carriage and said first pusher element in a second direction along said first rail with said first pusher element in the retracted position, and second drive means for moving said second carriage and said second pusher element in the first direction along said second rail with said second pusher element in the extended position to push a stack of signatures from between said inner side surfaces of said first and second wall sections and for moving said second carriage and said second pusher elements in the second direction along said second rail with said second pusher element in the retracted position, at least a portion of said first pusher element being disposed between said first wall section and said first rail during at least a portion of the movement of said first carriage in the second direction along said first rail with said first pusher element in the retracted position, at least a portion of said second pusher element being disposed between said second wall section and said second rail during at least a portion of the movement of said second carriage in the second direction along said second rail with said second pusher element in the retracted position.

46. An apparatus comprising first and second pluralities of longitudinally extending signature support elements, signature support elements of said first plurality of signature support elements sequentially cooperating with signature support elements of said second plurality of signatures support elements to sequentially support groups of signatures, jogger means for jogging first and second end portions of each of the groups of signatures in turn while the group of signatures is supported by one of said signature support elements of said first plurality of signature support elements and one of said signature support elements of said second plurality of signature support elements, platform means disposed beneath said first and second pluralities of signature support elements and said jogger means for sequentially receiving groups of signatures from said first and second pluralities of signature support elements to form stacks of signatures, conveyor means for engaging the first end portion of at least one group of signatures in a stack of at least one group of signatures to push each of the stacks of signatures in turn with the second end portion of at least one group of signatures leading, and stack processing means for performing an operation on a stack of signatures at a work station in said stack processing means, said stack processing means including registration surface means for engaging an end portion of each stack of signatures in turn to locate each stack of signatures in turn relative to said stack processing means, said conveyor means including at least one pusher element for engaging an end portion of a stack of signatures disposed on said platform means, and drive means for moving said one pusher element to push the engaged stack of signatures from said platform means toward the work station in said stack processing means to move the stack of signatures into engagement with said registration surface means in said stack processing means, said drive means being operable to press said one pusher element against the stack of signatures to press the stack of signatures against said registration surface means prior to performing of an operation on the stack of signatures by said stack processing means. portions of each group of signatures extending between the first and second end portions of the groups of signatures, said conveyor means being operable to push each of the stacks of signatures in turn from a location between said first and second wall sections.

47. An apparatus as set forth in claim 46 wherein said drive means is operable to move said one pusher element to push the processed stack of signatures away from said work station in said stack processing means.

48. An apparatus as set forth in claim 46 wherein said drive means maintains said one pusher element in engagement with a stack of signatures from the time said one pusher element engages a stack of signatures on said platform means until said one pusher element presses the stack of signatures against said registration surface means.

49. An apparatus as set forth in claim 46 wherein said conveyor means includes a rail and a carriage movable along said rail, said one pusher element being movable relative to said carriage between an extended position in which a stack engaging portion of said one pusher element is aligned with a central portion of said platform means and a retracted position in which said stack engaging portion of said one pusher element is offset to one side of the central portion of said platform means and is disposed adjacent to said rail, said drive means being operable to move said carriage and said one pusher element in a first direction along said rail to push a stack of signatures toward said stack processing means when said one pusher element is in the extended position and being operable to move said carriage and said one pusher element in a second direction along said rail with said one pusher element in the retracted position and said stack engaging portion of said one pusher element disposed between said rail and the central portion of said platform means.

50. An apparatus as set forth in claim 49 wherein said drive means is reversible to move said carriage and said one pusher element in the second direction along said rail with said one pusher element in the extended position to push a stack in the second direction from said platform means and to move said carriage and said one pusher element in the first direction along said rail with said one pusher element in the retracted position.

51. An apparatus comprising first and second pluralities of signature support elements, signature support elements of said first plurality of signature support elements cooperating with signature support elements of said second plurality of signature support elements to sequentially form groups of signatures, turntable means disposed beneath said first and second pluralities of signature support elements for sequentially receiving groups of signatures from said first and second pluralities of signature support elements, said turntable means including a platform and means for rotating said platform about an axis which extends between said first and second pluralities of signature support elements to change the orientation of a group of signatures on said platform relative to said first and second pluralities of signature support elements, strapper means for tying a band around a stack of signatures formed by a plurality of groups of signatures while the stack of signatures is disposed at a tying station in said strapper means, and conveyor means for sequentially moving stacks of signatures from said turntable means to said tying station in said strapper means, said conveyor means including a first pusher element for engaging at least one end portion of a first stack of signatures on said platform of said turntable means and for pushing the first stack of signatures in a first direction from said platform to the tying station in said strapper means, and a second pusher element for engaging at least one end portion of a second stack of signatures on said platform of said turntable means and for pushing the second stack of signatures in the first direction from said platform to the tying station in said strapper means, said second pusher element being spaced from the first stack of signatures during pushing of the first stack of signatures by said first pusher element, said first pusher element being spaced from said second stack of signatures during pushing of the second stack of signatures by said second pusher element.

52. An apparatus as set forth in claim 51 wherein said platform has a circular configuration and includes surface means for defining a channel extending diametrically across at least a portion of said platform, said first pusher element being movable into one end of said channel and movable along said channel to engage the first stack of signatures on said platform and push the first stack of signatures off of said platform, said second pusher element being movable into one end of said channel and movable along said channel to engage the second stack of signatures on said platform and push the second stack of signatures off of said platform.

53. An apparatus as set forth in claim 51 wherein said first pusher element is movable to push at least a portion of the first stack of signatures from the tying station after said strapper means has tied a band around the first stack of signatures, said second pusher element being movable to push at least a portion of the second stack of signatures from the tying station after said strapper means has tied a band around the second stack of signatures.

54. An apparatus as set forth in claim 53 wherein said first pusher element is maintained in engagement with the first stack of signatures from the time said first pusher element engages the first stack of signatures on said platform until said first pusher element pushes at least a portion of the first stack of signatures out of the tying station, said second pusher element being maintained in engagement with the second stack of signatures from the time said second pusher element engages the second stack of signatures on said platform until said second pusher element pushes at least a portion of the second stack of signatures out of the tying station.

55. An apparatus as set forth in claim 51 wherein said conveyor means includes a first rail, a first carriage movable along said first rail, said first pusher element being connected with said first carriage, said first pusher element being movable between an extended position in which said first pusher element extends outward for a first distance from said first carriage and a retracted position in which said first pusher element extends outward from said first carriage for a second distance which is less than said first distance, first drive means for moving said first pusher element and said first carriage along said first rail in a first direction with said first pusher element in the extended position to move the first stack of signatures relative to said platform along a stack discharge path, said first drive means being operable to move said first pusher element and said first carriage in a second direction along said first rail with said first pusher element in the retracted position and with at least a portion of said first pusher element disposed between said first rail and the stack discharge path, a second rail extending parallel to said first rail, said stack discharge path being disposed between said first and second rails, a second carriage movable along said second rail, said second pusher element being connected with said second carriage, said second pusher element being movable between an extended position in which said second pusher element extends outward for a first distance from said second carriage and a retracted position in which said second pusher element extends outward from said second carriage for a second distance which is less than the first distance which said second pusher element extends outward from said second carriage, second drive means for moving said second pusher element and said second carriage along said second rail in the first direction with said second pusher element in the extended position to move the second stack of signatures relative to said platform along the stack discharge path, said second drive means being operable to move said second pusher element and said second carriage in the second direction along said second rail with said second pusher element in the retracted position and with at least a portion of said second pusher element disposed between said second rail and the stack discharge path.

56. An apparatus comprising first and second pluralities of longitudinally extending signature support elements, signature support elements of said first plurality of signature support elements sequentially cooperating with signature support elements of said second plurality of signatures support elements to sequentially support groups of signatures, a platform disposed beneath said first and second pluralities of signature support elements for sequentially receiving groups of signatures from said first and second pluralities of signature support elements to sequentially form stacks of signatures, a receiving station for sequentially receiving stacks of signatures, said receiving station including registration surface means for engaging a first end portion of each stack of signatures in turn to locate each stack of signatures in turn relative to said receiving station, and conveyor means for sequentially moving stacks of signatures from said platform to said receiving station, said conveyor means including a first pusher element for engaging at least one end portion of a first stack of signatures on said platform and for pushing the first stack of signatures from said platform into engagement with said registration surface means at the receiving station, and a second pusher element for engaging at least one end portion of a second stack of signatures on said platform and for pushing the second stack of signatures from said platform into engagement with said registration surface means at the receiving station.

57. An apparatus as set forth in claim 56 wherein said platform includes surface means for defining a channel extending across said platform, said first pusher element being movable into one end of said channel and movable along said channel to engage the first stack of signatures on said platform and push the first stack of signatures off of said platform, said second pusher element being movable into one end of said channel and movable along said channel to engage the second stack of signatures on said platform and push the second stack of signatures off of said platform.

58. An apparatus as set forth in claim 56 further including strapper means at the receiving station for tying a band around each stack of signatures in turn while the stack of signatures is in engagement with said registration surface means, said first pusher element being movable to push at least a portion of the first stack of signatures from the receiving station after said strapper means has tied a band around the first stack of signatures, said second pusher element being movable to push at least a portion of the second stack of signatures from the receiving station after said strapper means has tied a band around the second stack of signatures.

59. An apparatus as set forth in claim 58 wherein said first pusher element is maintained in engagement with the first stack of signatures from the time said first pusher element engages the first stack of signatures on said platform until said first pusher element pushes at least a portion of the first stack of signatures out of the receiving station, said second pusher element being maintained in engagement with the second stack of signatures from the time said second pusher element engages the second stack of signatures on said platform until said second pusher element pushes at least a portion of the second stack of signatures out of the receiving station.

60. An apparatus as set forth in claim 56 wherein said conveyor means includes a first rail, a first carriage movable along said first rail, said first pusher element being connected with said first carriage, said first pusher element being movable between an extended position in which said first pusher element extends outward for a first distance from said first carriage and a retracted position in which said first pusher element extends outward from said first carriage for a second distance which is less than said first distance, first drive means for moving said first pusher element and said first carriage along said first rail in a first direction with said first pusher element in the extended position to move the first stack of signatures relative to said platform along a stack discharge path, said first drive means being operable to move said first pusher element and said first carriage in a second direction along said first rail with said first pusher element in the retracted position and with at least a portion of said first pusher element disposed between said first rail and the stack discharge path, a second rail extending parallel to said first rail, said stack discharge path disposed between said first and second rails, a second carriage movable along said second rail, said second pusher element being connected with said second carriage, said second pusher element being movable between an extended position in which said second pusher element extends outward for a first distance from said second carriage and a retracted position in which said second pusher element extends outward from said second carriage for a second distance which is less than the first distance which said second pusher element extends outward from said second carriage, second drive means for moving said second pusher element and said second carriage along said second rail in the first direction with said second pusher element in the extended position to move a second stack of signatures relative to said platform along the stack discharge path, said second pusher element being spaced from the first stack during movement of the first stack along the stack discharge path, said first pusher element being spaced from the second stack during movement of the second stack along the stack discharge path, said second drive means being operable to move said second pusher element and said second carriage in the second direction along said second rail with said second pusher element in the retracted position and with at least a portion of said second pusher element disposed between said second rail and the stack discharge path.

61. An apparatus as set forth in claim 56 further including strapper means at the receiving station for tying a band around each stack of signatures in turn while the stack of signatures is in engagement with said registration surface means.

* * * * *